US011557413B2

(12) United States Patent
Ushigami et al.

(10) Patent No.: US 11,557,413 B2
(45) Date of Patent: Jan. 17, 2023

(54) GRAIN-ORIENTED ELECTRICAL STEEL SHEET AND METHOD OF PRODUCING THE SAME

(71) Applicant: NIPPON STEEL CORPORATION, Tokyo (JP)

(72) Inventors: Yoshiyuki Ushigami, Tokyo (JP); Masato Mizokami, Tokyo (JP); Shingo Okada, Tokyo (JP); Yoichi Zaizen, Tokyo (JP); Shinji Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/423,013

(22) PCT Filed: Jan. 16, 2020

(86) PCT No.: PCT/JP2020/001181
§ 371 (c)(1),
(2) Date: Jul. 14, 2021

(87) PCT Pub. No.: WO2020/149340
PCT Pub. Date: Jul. 23, 2020

(65) Prior Publication Data

US 2022/0068526 A1 Mar. 3, 2022

(30) Foreign Application Priority Data

Jan. 16, 2019 (JP) ..... JP2019-005396
Jan. 16, 2019 (JP) ..... JP2019-005398

(51) Int. Cl.
*C22C 38/00* (2006.01)
*C22C 38/02* (2006.01)
(Continued)

(52) U.S. Cl.
CPC ..... *H01F 1/147* (2013.01); *C21D 3/04* (2013.01); *C21D 6/001* (2013.01); *C21D 6/002* (2013.01);
(Continued)

(58) Field of Classification Search
CPC ... C22C 38/001; C22C 38/002; C22C 38/008; C22C 38/02; C22C 38/04; C22C 38/06; C22C 38/12
(Continued)

(56) References Cited

U.S. PATENT DOCUMENTS 3,932,236 A 1/1976 Wada et al.
2017/0274432 A1 9/2017 Okubo et al.

FOREIGN PATENT DOCUMENTS

EP 0 565 029 A1 10/1993
JP 52-24499 B2 7/1977
(Continued)

OTHER PUBLICATIONS

Fujii et al., JP-06136555—A machine translation (printed on Apr. 15, 2022), May 17, 1994, entire translation (Year: 1994).*

*Primary Examiner* — Humera N. Sheikh
*Assistant Examiner* — Katherine A Christy
(74) *Attorney, Agent, or Firm* — Birch, Stewart, Kolasch & Birch, LLP

(57) ABSTRACT

A grain-oriented electrical steel sheet according to the present invention includes a silicon steel sheet as a base steel sheet, and when an average value of amplitudes in a wavelength range of 20 to 100 μm among wavelength components obtained by performing Fourier analysis on a measured cross-sectional curve parallel to a sheet width direction of the silicon steel sheet is set as ave-$AMP_{C100}$, ave-$AMP_{C100}$ is 0.0001 to 0.050 μm.

17 Claims, 3 Drawing Sheets

(51) Int. Cl.

| | |
|---|---|
| ***C22C 38/04*** | (2006.01) |
| ***C22C 38/06*** | (2006.01) |
| ***C22C 38/12*** | (2006.01) |
| ***H01F 1/147*** | (2006.01) |
| ***C21D 3/04*** | (2006.01) |
| ***C21D 6/00*** | (2006.01) |
| ***C21D 8/00*** | (2006.01) |
| ***C21D 8/12*** | (2006.01) |
| ***C21D 9/46*** | (2006.01) |
| ***C22C 38/14*** | (2006.01) |
| ***C22C 38/16*** | (2006.01) |

(52) U.S. Cl.
CPC ..... *C21D 6/005* (2013.01); *C21D 6/008* (2013.01); *C21D 8/005* (2013.01); *C21D 8/1233* (2013.01); *C21D 9/46* (2013.01); *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/16* (2013.01)

(58) Field of Classification Search
USPC ..... 428/469
See application file for complete search history.

(56) References Cited

FOREIGN PATENT DOCUMENTS

| | | | | |
|---|---|---|---|---|
| JP | 5-311453 | A | | 11/1993 |
| JP | 06136555 | A | * | 5/1994 |
| JP | 2016-47942 | A | | 4/2016 |
| JP | 2016-47943 | A | | 4/2016 |
| JP | 2018-62682 | A | | 4/2018 |
| JP | 2018-124265 | A | | 8/2018 |
| WO | WO 2012/164702 | A1 | | 12/2012 |

* cited by examiner

GRAIN-ORIENTED ELECTRICAL STEEL SHEET AND METHOD OF PRODUCING THE SAME

TECHNICAL FIELD

The present invention relates to a grain-oriented electrical steel sheet and a method of producing the same, and particularly, to a grain-oriented electrical steel sheet that exhibits excellent iron loss characteristics due to surface properties of a silicon steel sheet which is a base steel sheet being controlled and a method of producing the same.

Priority is claimed on Japanese Patent Application No. 2019-5396, filed Jan. 16, 2019, and Japanese Patent Application No. 2019-5398, filed Jan. 16, 2019, the content of which is incorporated herein by reference.

BACKGROUND ART

A grain-oriented electrical steel sheet includes a silicon steel sheet as a base steel sheet and is a soft magnetic material that is mainly used as an iron core material of a transformer. Grain-oriented electrical steel sheets are required to exhibit excellent magnetic properties. In particular, it is required that excellent iron loss characteristics be exhibited.

The iron loss means an energy loss that occurs when electrical energy and magnetic energy are mutually converted. A smaller value for the iron loss is more preferable. Iron loss can be roughly divided into two loss components: hysteresis loss and eddy current loss. In addition, the eddy current loss can be divided into classical eddy current loss and anomalous eddy current loss.

For example, increasing the electrical resistance of a silicon steel sheet, reducing the thickness of a silicon steel sheet, and insulating a silicon steel sheet by the coating have been attempted to reduce the classical eddy current loss. In addition, reducing the grain size of a silicon steel sheet, reducing the magnetic domain of a silicon steel sheet and applying tension to a silicon steel sheet have been attempted to reduce the anomalous eddy current loss. In addition, removing impurities in a silicon steel sheet and controlling the crystal orientation of the silicon steel sheet have been attempted to reduce the hysteresis loss.

In addition, making the surface of a silicon steel sheet smooth has been attempted to reduce the hysteresis loss. When the surface of a silicon steel sheet has irregularities, they hinder movement of the domain wall, and magnetization is unlikely to occur. Therefore, reducing the energy loss due to the domain wall motion by reducing the surface roughness of the silicon steel sheet has been attempted.

For example, Patent Document 1 discloses a grain-oriented electrical steel sheet in which excellent iron loss characteristics are obtained by smoothing the surface of the steel sheet. Patent Document 1 discloses that, when the surface of the steel sheet is mirror-finished by chemical polishing or electrolytic polishing, the iron loss significantly decreases.

Patent Document 2 discloses a grain-oriented electrical steel sheet in which the surface roughness Ra of the steel sheet is controlled such that it is 0.4 μm or less. Patent Document 2 discloses that, when the surface roughness Ra is 0.4 μm or less, a very low iron loss is obtained.

Patent Document 3 discloses a grain-oriented electrical steel sheet in which the surface roughness Ra of the steel sheet in a direction perpendicular to a rolling direction is controlled such that it is 0.15 to 0.45 μm. Patent Document 3 discloses that, when the surface roughness in the direction perpendicular to the rolling direction is larger than 0.45 μm, an effect of improving the high magnetic field iron loss becomes weak.

Patent Document 4 and Patent Document 5 disclose non-oriented electrical steel sheets in which the surface roughness Ra is controlled such that it is 0.2 μm or less when the cutoff wavelength λc is 20 μm. Patent Document 4 and Patent Document 5 disclose that, in order to reduce the iron loss, it is necessary to remove undulations on the longer wavelength side at a cutoff wavelength, evaluate fine irregularities, and reduce the amount of these fine irregularities.

CITATION LIST

Patent Document

[Patent Document 1]
Japanese Examined Patent Application, Second Publication No. S52-024499
[Patent Document 2]
Japanese Unexamined Patent Application, First Publication No. H05-311453
[Patent Document 3]
Japanese Unexamined Patent Application, First Publication No. 2018-062682
[Patent Document 4]
Japanese Unexamined Patent Application, First Publication No. 2016-47942
[Patent Document 5]
Japanese Unexamined Patent Application, First Publication No. 2016-47943

SUMMARY OF THE INVENTION

Problems to be Solved by the Invention

The inventors conducted studies, and as a result, clarified that, as in the related art, even if the surface roughness Ra of a silicon steel sheet is controlled such that it is, for example, 0.40 μm or less, or the surface roughness Ra is controlled such that it is 0.2 μm or less under conditions of a cutoff wavelength λc of 20 μm, the iron loss characteristics are not always sufficiently and stably improved.

Furthermore, in Patent Document 4 and Patent Document 5, in order to improve iron loss characteristics of the non-oriented electrical steel sheet, the surface properties of the silicon steel sheet are controlled by cold rolling. However, in the grain-oriented electrical steel sheet, unlike a non-oriented electrical steel sheet, after cold rolling, decarburization annealing is performed, an annealing separator is applied, final annealing is performed, and additionally purification annealing is performed at a high temperature for a long time. Therefore, in the grain-oriented electrical steel sheet, it is difficult to maintain the surface properties controlled by cold rolling until after the final process, unlike a non-oriented electrical steel sheet. Generally, knowledge about a non-oriented electrical steel sheets cannot simply be applied to a grain-oriented electrical steel sheet.

The inventors consider surface control of grain-oriented electrical steel sheets to be insufficient in the related art, and, with a new perspective, postulate that, in order to optimally improve iron loss characteristics of a grain-oriented electrical steel sheet, it would be necessary to control surface properties of a silicon steel sheet.

That is, an object of the present invention is to provide a grain-oriented electrical steel sheet that exhibits excellent iron loss characteristics due to optimally controlling surface properties of a silicon steel sheet which is a base steel sheet and a method of producing the same.

Means for Solving the Problem

The scope of the present invention is as follows.

(1) A grain-oriented electrical steel sheet according to an aspect of the present invention includes a silicon steel sheet as a base steel sheet, and when an average value of amplitudes in a wavelength range of 20 to 100 μm among wavelength components obtained by performing Fourier analysis on a measured cross-sectional curve parallel to a sheet width direction of the silicon steel sheet is set as ave-$AMP_{C100}$, ave-$AMP_{C100}$ is 0.0001 to 0.050 μm.

(2) In the grain-oriented electrical steel sheet according to (1), ave-$AMP_{C100}$ may be 0.0001 to 0.025 μm.

(3) In the grain-oriented electrical steel sheet according to (1) or (2), when a maximum value of amplitudes in a wavelength range of 20 to 100 μm among wavelength components obtained by performing Fourier analysis on the measured cross-sectional curve parallel to the sheet width direction of the silicon steel sheet is set as max-$AMP_{C100}$ and a maximum value of amplitudes in a wavelength range of 20 to 100 μm among wavelength components obtained by performing Fourier analysis on a measured cross-sectional curve parallel to the rolling direction of the silicon steel sheet is set as max-$AMP_{L100}$, max-$DIV_{100}$, which is a value obtained by dividing max-$AMP_{C100}$ by max-$AMP_{L100}$, may be 1.5 to 6.0.

(4) In the grain-oriented electrical steel sheet according to any one of (1) to (3), when an average value of amplitudes in a wavelength range of 20 to 50 μm among the wavelength components obtained by performing Fourier analysis is set as ave-$AMP_{C50}$, ave-$AMP_{C50}$ may be 0.0001 to 0.035.

(5) In the grain-oriented electrical steel sheet according to (4), when a maximum value of amplitudes in a wavelength range of 20 to 50 μm among wavelength components obtained by performing Fourier analysis on the measured cross-sectional curve parallel to the sheet width direction of the silicon steel sheet is set as max-$AMP_{C50}$ and a maximum value of amplitudes in a wavelength range of 20 to 50 μm among wavelength components obtained by performing Fourier analysis on the measured cross-sectional curve parallel to the rolling direction of the silicon steel sheet is set as max-$AMP_{L50}$, max-$DIV_{50}$, which is a value obtained by dividing max-$AMP_{C50}$ by max-$AMP_{L50}$, may be 1.5 to 5.0.

(6) In the grain-oriented electrical steel sheet according to (4) or (5), ave-$AMP_{C50}$ may be 0.0001 to 0.020 μm.

(7) In the grain-oriented electrical steel sheet according to any one of (1) to (6), the silicon steel sheet may contain, as chemical components, by mass %, Si: 0.8% or more and 7.0% or less, Mn: 0 or more and 1.00% or less, Cr: 0 or more and 0.30% or less, Cu: 0 or more and 0.40% or less, P: 0 or more and 0.50% or less, Sn: 0 or more and 0.30% or less, Sb: 0 or more and 0.30% or less, Ni: 0 or more and 1.00% or less, B: 0 or more and 0.008% or less, V: 0 or more and 0.15% or less, Nb: 0 or more and 0.2% or less, Mo: 0 or more and 0.10% or less, Ti: 0 or more and 0.015% or less, Bi: 0 or more and 0.010% or less, Al: 0 or more and 0.005% or less, C: 0 or more and 0.005% or less, N: 0 or more and 0.005% or less, S: 0 or more and 0.005% or less, and Se: 0 or more and 0.005% or less with the remainder being Fe and impurities.

(8) In the grain-oriented electrical steel sheet according to any one of (1) to (7), the silicon steel sheet may have a texture developed in the {110}<001> orientation.

(9) The grain-oriented electrical steel sheet according to any one of (1) to (8) may further include an intermediate layer arranged in contact with the silicon steel sheet, and the intermediate layer may be a silicon oxide film.

(10) The grain-oriented electrical steel sheet according to (9) may further an insulation coating arranged in contact with the intermediate layer, and the insulation coating may be a phosphoric acid-based coating.

(11) The grain-oriented electrical steel sheet according to (9) may further include an insulation coating arranged in contact with the intermediate layer, and the insulation coating is an aluminum borate-based coating.

(12) A method of producing the grain-oriented electrical steel sheet according to any one of (1) to (11) includes producing a grain-oriented electrical steel sheet using the silicon steel sheet as a base.

Effects of the Invention

According to the above aspects of the present invention, it is possible to provide a grain-oriented electrical steel sheet that exhibits excellent iron loss characteristics by optimally controlling surface properties of a silicon steel sheet which is a base steel sheet and a method of producing the same.

EMBODIMENT(S) FOR IMPLEMENTING THE INVENTION

Preferable embodiments of the present invention will be described below in detail. However, the present invention is not limited to only the configuration disclosed in the present embodiment, and can be variously modified without departing from the gist of the present invention. In addition, lower limit values and the upper limit values are included in the numerical value limiting ranges stated below. Numerical values indicated by "more than" or "less than" are not included in these numerical value ranges. "%" indicating the amount of respective elements means "mass %".

First Embodiment

In the present embodiment, unlike the related art, a surface state of a silicon steel sheet which is a base steel sheet of a grain-oriented electrical steel sheet is precisely and optimally controlled. Specifically, the surface properties of the silicon steel sheet are controlled in a sheet width direction (C direction) in a wavelength range of 20 to 100 μm.

For example, inside a transformer, the grain-oriented electrical steel sheet is magnetized with an alternating current. In this manner, when electrical energy and magnetic energy are mutually converted, in the grain-oriented electrical steel sheet, the magnetization direction is reversed mainly in a rolling direction (L direction) according to the AC cycle.

When the magnetization direction is reversed in the rolling direction, in the grain-oriented electrical steel sheet, the domain wall repeatedly moves mainly in the sheet width direction according to the AC cycle. Therefore, the inventors thought that, firstly, it is preferable to control a factor that inhibits domain wall motion in the sheet width direction.

Figure 2:
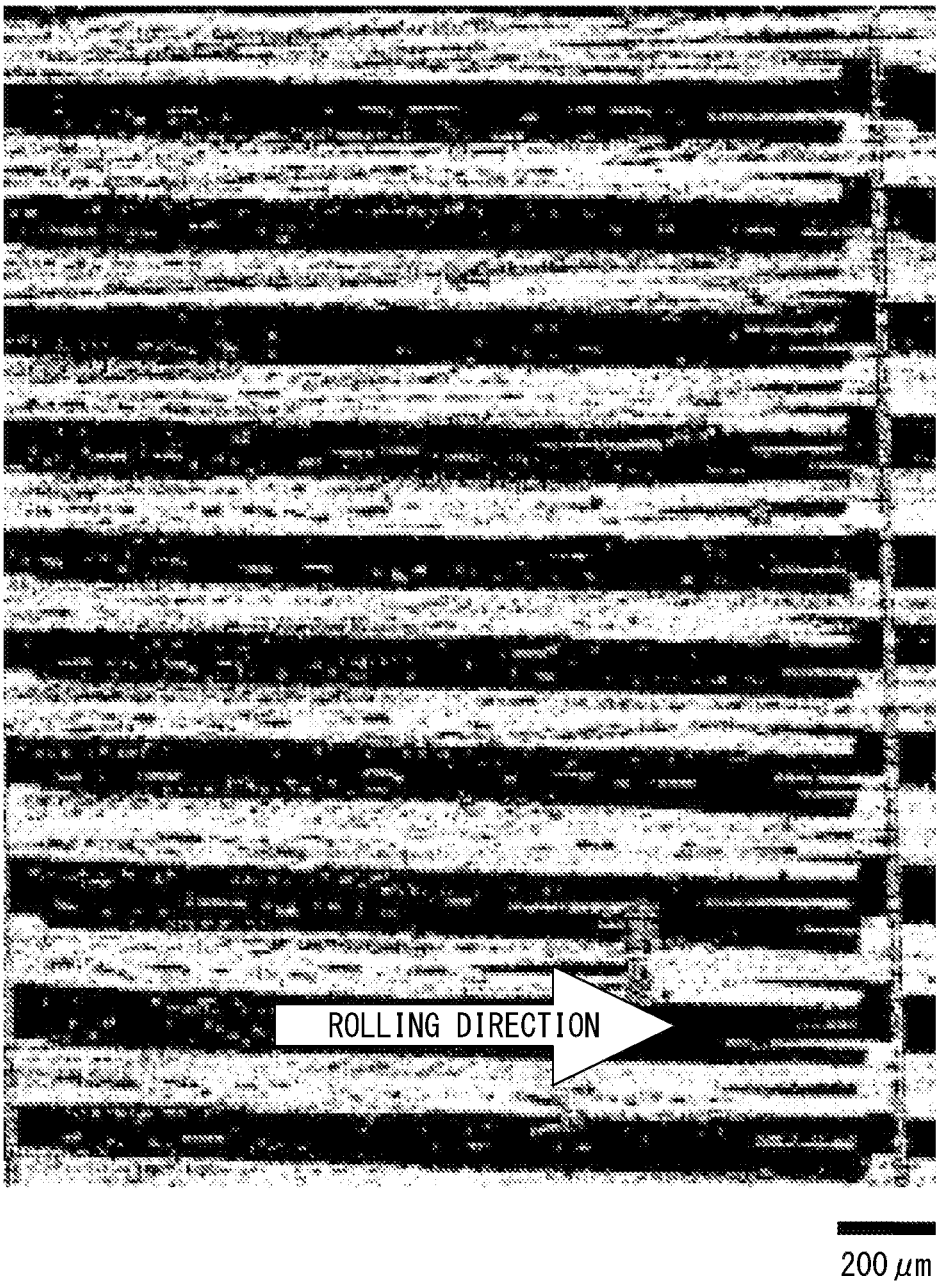
FIG. 2 is a microscopic image showing an example of a magnetic domain structure of the grain-oriented electrical steel sheet.

In addition, when the domain wall repeatedly moves in the sheet width direction according to the AC cycle, in consideration of the size of the magnetic domain of the grain-oriented electrical steel sheet, the moving distance of the domain wall is estimated to be about 20 to 100 μm. FIG. 2 shows a microscopic image of magnetic domain structure examples of a grain-oriented electrical steel sheet. As shown in FIG. 2, the grain-oriented electrical steel sheet basically has a stripe-shaped magnetic domain structure parallel to the rolling direction (L direction). In the grain-oriented electrical steel sheet, the width of the magnetic domain in the sheet width direction (C direction) is generally about 20 to 100 μm. Therefore, the inventors thought that, secondly, it is preferable to control a factor that inhibits domain wall motion in an area of 20 to 100 μm.

The grain-oriented electrical steel sheet according to the present embodiment is obtained based on the above findings. In the present embodiment, among wavelength components obtained by performing Fourier analysis on a measured cross-sectional curve parallel to the sheet width direction of the silicon steel sheet (base steel sheet), an amplitude in a wavelength range of 20 to 100 μm is controlled.

Specifically, when the average value of amplitudes in a wavelength range of 20 to 100 μm among the wavelength components obtained by performing Fourier analysis is set as ave-$AMP_{C100}$, ave-$AMP_{C100}$ is controlled such that it is 0.050 μm or less. When ave-$AMP_{C100}$ is 0.050 μm or less, the domain wall motion is not hindered by surface unevenness, and the domain wall can move suitably in the sheet width direction. As a result, the iron loss can be suitably reduced. In order to further facilitate the domain wall motion, ave-$AMP_{C100}$ is preferably 0.040 μm or less, more preferably 0.030 μm or less, still more preferably 0.025 μm or less, and most preferably 0.020 μm or less.

Since a smaller value of ave-$AMP_{C100}$ is more preferable, the lower limit of ave-$AMP_{C100}$ is not particularly limited. However, since it is not industrially easy to control ave-$AMP_{C100}$ such that it is less than 0.0001 μm, ave-$AMP_{C100}$ may be 0.0001 μm or more.

In addition, it is preferable to control the value of ave-$AMP_{C100}$ and then control an amplitude in a wavelength range of 20 to 50 μm. Since ave-$AMP_{C100}$ is an average value of amplitudes in a wavelength range of 20 to 100 μm, this value tends to be easily influenced by an amplitude with a large wavelength in a range of 20 to 100 μm. Therefore, in addition to the control of ave-$AMP_{C100}$, the amplitude in a wavelength range of 20 to 50 μm is also controlled, and thus the surface properties of the silicon steel sheet can be more suitably controlled.

Specifically, when the average value of amplitudes in a wavelength range of 20 to 50 μm among the wavelength components obtained by performing Fourier analysis is set as ave-$AMP_{C50}$, ave-$AMP_{C50}$ is controlled such that it is 0.035 μm or less. When ave-$AMP_{C50}$ is 0.035 μm or less, since the domain wall can more easily move in the sheet width direction, the iron loss can be suitably reduced. Ave-$AMP_{C50}$ is preferably 0.030 μm or less, more preferably 0.025 μm or less, still more preferably 0.020 μm or less, and most preferably 0.015 μm or less.

Since a smaller value of ave-$AMP_{C50}$ is more preferable, the lower limit of ave-$AMP_{C50}$ is not particularly limited. However, since it is not industrially easy to control ave-$AMP_{C50}$ such that it is less than 0.0001 μm, ave-$AMP_{C50}$ may be 0.0001 μm or more.

Figure 1:
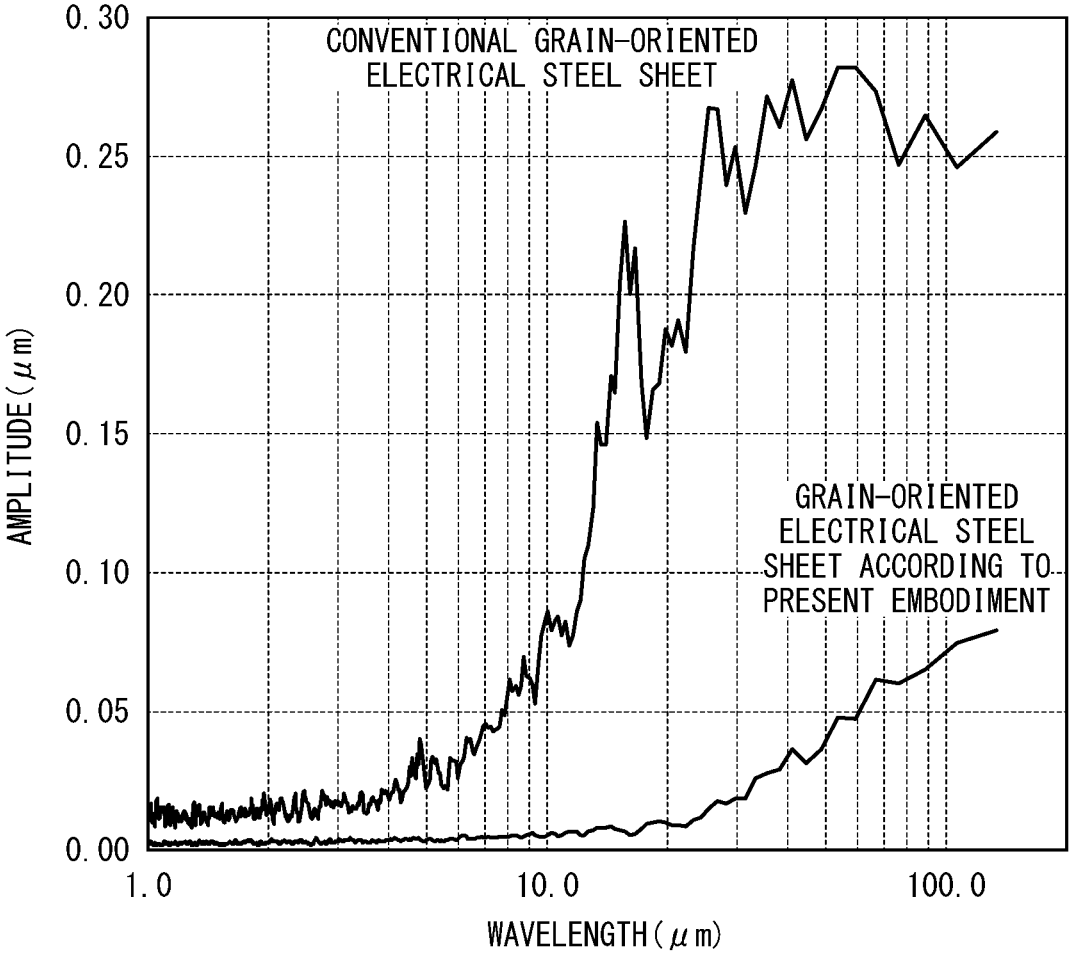
FIG. 1 shows a graph illustrating a plot of the amplitude with respect to the wavelength from Fourier analysis of a measured cross-sectional curve parallel to a sheet width direction of a silicon steel sheet, regarding a grain-oriented electrical steel sheet according to one embodiment of the present invention and a conventional grain-oriented electrical steel sheet.

FIG. 1 shows a graph obtained when measured cross-sectional curves parallel to the sheet width direction of the silicon steel sheet (base steel sheet) is subjected to Fourier analysis and the amplitude is plotted with respect to the wavelength. As shown in FIG. 1, in the silicon steel sheet of the conventional grain-oriented electrical steel sheet, the amplitude has a small value in a wavelength range of 20 μm or less, but the amplitude has a large value in a wavelength range of more than 20 μm. Specifically, in the silicon steel sheet of the conventional grain-oriented electrical steel sheet, the amplitude average value is 0.02 μm in a wavelength range of 1 to 20 μm, but the amplitude average value is 0.25 μm in a wavelength range of 20 to 100 μm. That is, even if surface properties are controlled microscopically in an area with a wavelength of 20 μm or less, it is clearly understood that surface properties are not controlled in an area with a wavelength of 20 to 100 μm, which is important for domain wall motion in the grain-oriented electrical steel sheet. On the other hand, as shown in FIG. 1, in the silicon steel sheet of the grain-oriented electrical steel sheet according to the present embodiment, the amplitude in a wavelength range of 20 to 100 μm has a small value. On the other hand, in the silicon steel sheet of the conventional grain-oriented electrical steel sheet, the amplitude in a wavelength range of 20 to 100 μm has a large value.

ave-$AMP_{C100}$ and ave-$AMP_{C50}$ may be measured by, for example, the following method.

When there is no coating on the silicon steel sheet, the surface properties of the silicon steel sheet may be evaluated directly, and when there is a coating on the silicon steel sheet, the surface properties of the silicon steel sheet may be evaluated after the coating is removed. For example, a grain-oriented electrical steel sheet having a coating may be immersed in a high-temperature alkaline solution. Specifically, immersion into a sodium hydroxide aqueous solution containing NaOH: 20 mass %+$H_2O$: 80 mass % is performed at 80° C. for 20 minutes and washing with water and drying are then performed, and thus the coating (the intermediate layer and the insulation coating) on the silicon steel sheet can be removed. Here, the time for immersion in the sodium hydroxide aqueous solution may be changed according to the thickness of the coating on the silicon steel sheet.

Regarding the surface properties of the silicon steel sheet, in a contact type surface roughness measuring instrument, the contact needle tip radius is generally about micron (μm), and a fine surface shape cannot be detected. Therefore, it is preferable to use a non-contact type surface roughness measuring instrument. For example, a laser type surface roughness measuring instrument (VK-9700 commercially available from Keyence Corporation) may be used.

First, a measured cross-sectional curve in the sheet width direction of the silicon steel sheet is obtained using a non-contact type surface roughness measuring instrument. When this measured cross-sectional curve is obtained, one measurement length is 500 μm or more, and a total measurement length is 5 mm or more. The spatial resolution in the measurement direction (the sheet width direction of the silicon steel sheet) is 0.2 μm or less. The measured cross-sectional curve is subjected to Fourier analysis without applying a low pass or high pass filter to the measured cross-sectional curve, that is, without cutting off a specific wavelength component from the measured cross-sectional curve.

Among the wavelength components obtained by performing Fourier analysis on the measured cross-sectional curve, the average value of amplitudes in a wavelength range of 20 to 100 μm is obtained. The average value of the amplitudes is set as ave-$AMP_{C100}$. Similarly, among the wavelength components obtained by performing Fourier analysis on the measured cross-sectional curve, the average value of amplitudes in a wavelength range of 20 to 50 μm is obtained. The average value of the amplitudes is set as ave-$AMP_{C50}$. Here, the above measurement and analysis may be performed at five or more locations while changing measurement locations, and the average value thereof may be obtained.

In the present embodiment, ave-$AMP_{C100}$ is controlled, and as necessary, ave-$AMP_{C50}$ is controlled to improve iron loss characteristics. A method of controlling these ave-$AMP_{C100}$ and ave-$AMP_{C50}$ will be described below.

In addition, in the grain-oriented electrical steel sheet according to the present embodiment, configurations other than the above surface properties are not particularly limited. However, it is preferable that the grain-oriented electrical steel sheet according to the present embodiment have the following technical features.

In the present embodiment, it is preferable that the silicon steel sheet contain a basic element as a chemical component, and as necessary, contain selective elements, with the remainder being Fe and impurities.

In the present embodiment, the silicon steel sheet may contain Si as a basic element (main alloying element).

Si: 0.8% or More and 7.0% or Less

Si (silicon) is an element that is a chemical component of the silicon steel sheet and is effective to increase the electrical resistance and reduce the iron loss. When the Si content is larger than 7.0%, the material may be easily cracked during cold rolling and may be difficult to roll. On the other hand, when the Si content is less than 0.8%, the electrical resistance may become small and the iron loss in the product may increase. Therefore, Si in a range of 0.8% or more and 7.0% or less may be contained. The lower limit of the Si content is preferably 2.0%, more preferably 2.5%, and still more preferably 2.8%. The upper limit of the Si content is preferably 5.0% and more preferably 3.5%.

In the present embodiment, the silicon steel sheet may contain impurities. Here, "impurities" are those that are mixed in from ore or scrap as a raw material when steel is industrially produced or from a production environment and the like.

In addition, in the present embodiment, the silicon steel sheet may contain selective elements in addition to the above basic element and impurities. For example, in place of some Fe of the above remainder, Mn, Cr, Cu, P, Sn, Sb, Ni, B, V, Nb, Mo, Ti, Bi, Al, C, N, S, and Se may be contained as selective elements. These selective elements may be contained according to the purpose. Therefore, it is not necessary to limit the lower limit value of these selective elements and the lower limit value may be 0%. In addition, if these selective elements are contained as impurities, the above effects are not impaired.

Mn: 0 or More and 1.00% or Less

Mn (manganese) is, like Si, an element that is effective in increasing the electrical resistance and reducing the iron loss. In addition, Mn binds with S or Se and functions as an inhibitor. Therefore, Mn may be contained in a range of 1.00% or less. The lower limit of the Mn content is preferably 0.05%, more preferably 0.08%, and still more preferably 0.09%. The upper limit of the Mn content is preferably 0.50% and more preferably 0.20%.

Cr: 0 or More and 0.30% or Less

Cr (chromium) is, like Si, an element that is effective in increasing the electrical resistance and reducing the iron loss. Therefore, Cr may be contained in a range of 0.30% or less. The lower limit of the Cr content is preferably 0.02% and more preferably 0.05%. The upper limit of the Cr content is preferably 0.20% and more preferably 0.12%.

Cu: 0 or More and 0.40% or Less

Cu (copper) is also an element that is effective in increasing the electrical resistance and reducing the iron loss. Therefore, Cu may be contained in a range of 0.40% or less. When the Cu content is larger than 0.40%, the iron loss reducing effect is saturated, and a surface defect such as a "copper scab" during hot rolling may be caused. The lower limit of the Cu content is preferably 0.05% and more preferably 0.10%. The upper limit of the Cu content is preferably 0.30% and more preferably 0.20%.

P: 0 or More and 0.50% or Less

P (phosphorus) is also an element that is effective in increasing the electrical resistance and reducing the iron loss. Therefore, P may be contained in a range of 0.50% or less. When the P content is larger than 0.50%, a problem may occur in the rollability of the silicon steel sheet. The lower limit of the P content is preferably 0.005% and more preferably 0.01%. The upper limit of the P content is preferably 0.20% and more preferably 0.15%.

Sn: 0 or More and 0.30% or Less

Sb: 0 or More and 0.30% or Less

Sn (tin) and Sb (antimony) are elements that are effective for stabilizing secondary recrystallization and developing {110}<001> orientation. Therefore, Sn may be contained in a range of 0.30% or less and Sb may be contained in a range of 0.30% or less. When the Sn or Sb content is larger than 0.30%, magnetic properties may be adversely affected.

The lower limit of the Sn content is preferably 0.02% and more preferably 0.05%. The upper limit of the Sn content is preferably 0.15% and more preferably 0.10%.

The lower limit of the Sb content is preferably 0.01% and more preferably 0.03%. The upper limit of the Sb content is preferably 0.15% and more preferably 0.10%.

Ni: 0 or More and 1.00% or Less

Ni (nickel) is also an element that is effective in increasing the electrical resistance and reducing the iron loss. In addition, Ni is an element that is effective in controlling a hot-band metal structure and improving magnetic properties. Therefore, Ni may be contained in a range of 1.00% or less. When the Ni content is larger than 1.00%, secondary recrystallization may become unstable. The lower limit of the Ni content is preferably 0.01% and more preferably 0.02%. The upper limit of the Ni content is preferably 0.20% and more preferably 0.10%.

B: 0 or More and 0.008% or Less

B (boron) is an element that is effective for exhibiting an inhibitory effect as BN. Therefore, B may be contained in a range of 0.008% or less. When the B content is larger than 0.008%, magnetic properties may be adversely affected. The lower limit of the B content is preferably 0.0005% and more preferably 0.001%. The upper limit of the B content is preferably 0.005% and more preferably 0.003%.

V: 0 or More and 0.15% or Less

Nb: 0 or More and 0.2% or Less

Ti: 0 or More and 0.015% or Less

V (vanadium), Nb (niobium), and Ti (titanium) are elements that are effective in binding with N or C and functioning as an inhibitor. Therefore, V may be contained in a range of 0.15% or less, Nb may be contained in a range of 0.2% or less, and Ti may be contained in a range of 0.015% or less. When these elements remain in the final product (electrical steel sheet) and the V content is larger than 0.15%, the Nb content is larger than 0.2% or the Ti content is larger than 0.015%, magnetic properties may be deteriorated.

The lower limit of the V content is preferably 0.002% and more preferably 0.01%. The upper limit of the V content is preferably 0.10% and more preferably 0.05%.

The lower limit of the Nb content is preferably 0.005% and more preferably 0.02%. The upper limit of the Nb content is preferably 0.1% and more preferably 0.08%.

The lower limit of the Ti content is preferably 0.002% and more preferably 0.004%. The upper limit of the Ti content is preferably 0.010% and more preferably 0.008%.

Mo: 0 or More and 0.10% or Less

Mo (molybdenum) is also an element that is effective in increasing the electrical resistance and reducing the iron loss. Therefore, Mo may be contained in a range of 0.10% or less. When the Mo content is larger than 0.10%, a problem may occur in the rollability of the steel sheet. The lower limit of the Mo content is preferably 0.005% and more preferably 0.01%. The upper limit of the Mo content is preferably 0.08% and more preferably 0.05%.

Bi: 0 or More and 0.010% or Less

Bi (bismuth) is an element that is effective for stabilizing precipitates such as sulfide and improving a function as an inhibitor. Therefore, Bi may be contained in a range of 0.010% or less. When the Bi content is larger than 0.010%, magnetic properties may be adversely affected. The lower limit of the Bi content is preferably 0.001% and more preferably 0.002%. The upper limit of the Bi content is preferably 0.008% and more preferably 0.006%.

Al: 0 or More and 0.005% or Less

Al (aluminum) is an element that is effective in binding with N and exhibiting an inhibitory effect. Therefore, before final annealing, for example, Al may be contained in a range of 0.01 to 0.065% at the slab stage. However, if Al remains as impurities in the final product (electrical steel sheet) and the Al content is larger than 0.005%, magnetic properties may be adversely affected. Therefore, the Al content of the final product is preferably 0.005% or less. The upper limit of the Al content of the final product is preferably 0.004% and more preferably 0.003%. Here, the Al content of the final product corresponds to impurities, the lower limit is not particularly limited, and a smaller content is more preferable. However, since it is not industrially easy to control the Al content of the final product such that it is 0%, the lower limit of the Al content of the final product may be 0.0005%. Here, the Al content indicates the amount of acid-soluble Al.

C: 0 or More and 0.005% or Less,

N: 0 or More and 0.005% or Less,

C (carbon) is an element that is effective in adjusting primary recrystallization texture and improving magnetic properties. In addition, N (nitrogen) is an element that is effective in binding to Al, B, or the like and exhibiting an inhibitory effect. Therefore, before decarburization annealing, C may be contained in a range of 0.02 to 0.10%, for example, at the slab stage. In addition, before final annealing, N may be contained in a range of 0.01 to 0.05%, for example, in the stage after nitriding annealing. However, when these elements remain as impurities in the final product, and each of the C and N contents is larger than 0.005%, magnetic properties may be adversely affected. Therefore, the C or N content in the final product is preferably 0.005% or less. The C or N content in the final product is more preferably 0.004% or less and still more preferably 0.003% or less. In addition, total amounts of C and N in the final product is preferably 0.005% or less. Here, C and N in the final product are impurities, and the content thereof is not particularly limited, and a smaller content is more preferable. However, it is not industrially easy to control the C or N content in the final product such that it is 0%, the C or N content in the final product may be 0.0005% or more.

S: 0 or More and 0.005% or Less,

Se: 0 or More and 0.005% or Less

S (sulfur) and Se (selenium) are elements that are effective in bonding to Mn or the like and exhibiting an inhibitory effect. Therefore, before final annealing, S and Se each may be contained in a range of 0.005 to 0.050%, for example, at the slab stage. However, when these elements remain as impurities in the final product and each of the S and Se contents is larger than 0.005%, magnetic properties may be adversely affected. Therefore, the S or Se content in the final product is preferably 0.005% or less. The S or Se content in the final product is preferably 0.004% or less and more preferably 0.003% or less. In addition, total contents of S and Se in the final product is preferably 0.005% or less. Here, S and Se in the final product are impurities and the content thereof is not particularly limited, and a smaller content is more preferable. However, it is not industrially easy to control the S or Se content in the final product such that it is 0%, and the S or Se content in the final product may be 0.0005% or more.

In the present embodiment, the silicon steel sheet may contain, as selective elements, by mass %, at least one selected from the group consisting of Mn: 0.05% or more and 1.00% or less, Cr: 0.02% or more and 0.30% or less, Cu: 0.05% or more and 0.40% or less, P: 0.005% or more and 0.50% or less, Sn: 0.02% or more and 0.30% or less, Sb: 0.01% or more and 0.30% or less, Ni: 0.01% or more and 1.00% or less, B: 0.0005% or more and 0.008% or less, V: 0.002% or more and 0.15% or less, Nb: 0.005% or more and 0.2% or less, Mo: 0.005% or more and 0.10% or less, Ti: 0.002% or more and 0.015% or less, and Bi: 0.001% or more and 0.010% or less.

The chemical components of the silicon steel sheet described above may be measured by a general analysis method. For example, a steel component may be measured using inductively coupled plasma-atomic emission spectrometry (ICP-AES). Here, C and S may be measured using a combustion-infrared absorption method, N may be measured using an inert gas melting-thermal conductivity method, and O may be measured using an inert gas melting-non-dispersive infrared absorption method.

In addition, it is preferable that the silicon steel sheet of the grain-oriented electrical steel sheet according to the present embodiment have a texture developed in {110}<001> orientation. The {110}<001> orientation means a crystal orientation (Goss-orientation) in which the {110} planes are aligned parallel to the steel sheet surface and the <100> axes are aligned in the rolling direction. When the silicon steel sheet is controlled in the Goss-orientation, magnetic properties are preferably improved.

The texture of the silicon steel sheet described above may be measured by a general analysis method. For example, it may be measured by an X-ray diffraction (Laue method). The Laue method is a method of vertically irradiating an X-ray beam to the steel sheet and analyzing a transmitted or reflected diffraction spots. When the diffraction spots are analyzed, it is possible to identify crystal orientation of the location to which an X-ray beam is irradiating. If diffraction spots are analyzed at a plurality of locations while changing the irradiating position, it is possible to measure a crystal orientation distribution at each irradiating position. The Laue method is a method suitable for measuring the crystal orientation of a metal structure having coarse crystal grains.

In addition, the grain-oriented electrical steel sheet according to the present embodiment may have an intermediate layer arranged in contact with the silicon steel sheet or may have an insulation coating arranged in contact with the intermediate layer.

The intermediate layer is a silicon oxide film, and contains silicon oxide as a main component, and has a film thickness of 2 nm or more and 500 nm or less. The intermediate layer continuously extends along the surface of the silicon steel sheet. When the intermediate layer is formed between the silicon steel sheet and the insulation coating, the adhesion between the silicon steel sheet and the insulation coating is improved, and stress can be applied to the silicon steel sheet. In the present embodiment, the intermediate layer is not a forsterite coating but is preferably an intermediate layer (silicon oxide film) mainly containing silicon oxide.

The intermediate layer is formed by heating a silicon steel sheet in which formation of a forsterite coating is restricted during final annealing or a forsterite coating is removed after final annealing in an atmospheric gas that is adjusted to a predetermined oxidation degree ($PH_2O/PH_2$). In the present embodiment, the intermediate layer is preferably an externally oxidized layer formed by external oxidation.

Here, external oxidation is oxidation that occurs in a low-oxidation degree atmospheric gas, and means oxidation in the form in which an alloying element (Si) in a steel sheet diffuses to the surface of the steel sheet and an oxide is then formed in a film form on the surface of the steel sheet. On the other hand, internal oxidation is oxidation that occurs in a relatively high-oxidation degree atmospheric gas, and means oxidation in the form in which an alloying element in a steel sheet hardly diffuses to the surface, oxygen in the atmosphere diffuses into the steel sheet, and then disperses in an island form inside the steel sheet and an oxide is formed.

The intermediate layer contains silica (silicon oxide) as a main component. The intermediate layer may contain an oxide of alloying elements contained in the silicon steel sheet in addition to silicon oxide. That is, it may contain any oxide of Fe, Mn, Cr, Cu, Sn, Sb, Ni, V, Nb, Mo, Ti, Bi, and Al or a composite oxide thereof. In addition, it may contain metal grains such as Fe. In addition, impurities may be contained as long as the effects are not impaired.

The average thickness of the intermediate layer is preferably 2 nm or more and 500 nm or less. When the average thickness is less than 2 nm or larger than 500 nm, this is not preferable because the adhesion between the silicon steel sheet and the insulation coating decreases, and sufficient stress cannot be applied to the silicon steel sheet, and the iron loss increases. The lower limit of the average film thickness of the intermediate layer is preferably 5 nm. The upper limit of the average film thickness of the intermediate layer is preferably 300 nm, more preferably 100 nm, and still more preferably 50 nm.

The crystal structure of the intermediate layer is not particularly limited. However, the matrix phase of the intermediate layer is preferably amorphous. When the matrix phase of the intermediate layer is amorphous, the adhesion between the silicon steel sheet and the insulation coating can be preferably improved.

In addition, the insulation coating arranged in contact with the intermediate layer is preferably a phosphoric acid-based coating or an aluminum borate-based coating.

When the insulation coating is a phosphoric acid-based coating, preferably, the phosphoric acid-based coating contains a phosphorus silicon composite oxide (composite oxide containing phosphorous and silicon) and has a film thickness of 0.1 μm or more and 10 μm or less. The phosphoric acid-based coating continuously extends along the surface of the intermediate layer. When the phosphoric acid-based coating arranged in contact with the intermediate layer is formed, it is possible to further apply tension to the silicon steel sheet and suitably reduce the iron loss.

The phosphoric acid-based coating may contain an oxide of alloying elements contained in the silicon steel sheet in addition to the phosphorus silicon composite oxide. That is, it may contain any oxide of Fe, Mn, Cr, Cu, Sn, Sb, Ni, V, Nb, Mo, Ti, Bi, and Al or a composite oxide thereof. In addition, it may contain metal grains such as Fe. In addition, impurities may be contained as long as the effects are not impaired.

The average thickness of the phosphoric acid-based coating is preferably 0.1 μm or more and 10 μm or less. The upper limit of the average thickness of the phosphoric acid-based coating is preferably 5 μm and more preferably 3 μm. The lower limit of the average thickness of the phosphoric acid-based coating is preferably 0.5 μm and more preferably 1 μm.

The crystal structure of the phosphoric acid-based coating is not particularly limited. However, the matrix phase of the phosphoric acid-based coating is preferably amorphous. When the matrix phase of the phosphoric acid-based coating is amorphous, the adhesion between the silicon steel sheet and the phosphoric acid-based coating can be suitably improved.

In addition, when the insulation coating is an aluminum borate-based coating, preferably, the aluminum borate-based coating contains aluminum/boron oxide and has a film thickness of larger than 0.5 μm and 8 μm or less. The aluminum borate-based coating continuously extends along the surface of the intermediate layer. When the aluminum borate-based coating arranged in contact with the intermediate layer is formed, it is possible to further apply tension to the silicon steel sheet and suitably reduce the iron loss. For example, the aluminum borate-based coating can apply tension 1.5 to 2 times that of the phosphoric acid-based coating to the silicon steel sheet.

The aluminum borate-based coating may contain crystalline $Al_{18}B_4O_{33}$, $Al_4B_2O_9$, aluminum oxide, or boron oxide in addition to aluminum/boron oxide. In addition, it may contain metal grains such as Fe or an oxide. In addition, impurities may be contained as long as the effects are not impaired.

The average thickness of the aluminum borate-based coating is preferably more than 0.5 μm and 8 μm or less. The upper limit of the average thickness of the aluminum borate-based coating is preferably 6 μm and more preferably 4 μm. The lower limit of the average thickness of the aluminum borate-based coating is preferably 1 μm and more preferably 2 μm.

The crystal structure of the aluminum borate-based coating is not particularly limited. However, the matrix phase of the aluminum borate-based coating is preferably amorphous.

When the matrix phase of the aluminum borate-based coating is amorphous, the adhesion between the silicon steel sheet and the aluminum borate-based coating can be suitably improved.

The coating structure of the above grain-oriented electrical steel sheet may be observed by, for example, the following method.

A test piece is cut out from the grain-oriented electrical steel sheet, and the layer structure of the test piece is observed under a scanning electron microscope (SEM) or a transmission electron microscope (TEM). For example, a layer with a thickness of 300 nm or more may be observed under an SEM and a layer with a thickness of less than 300 nm may be observed under a TEM.

Specifically, first, a test piece is cut out so that the cutting direction is parallel to the sheet thickness direction (specifically, a test piece is cut out so that the cut surface is parallel to the sheet thickness direction and perpendicular to the rolling direction), and the cross-sectional structure of the cut surface is observed under an SEM at a magnification at which each layer is within an observation field of view. For example, when observed in a backscattered electron composition image (COMPO image), it is possible to infer the number of layers constituting the cross-sectional structure. For example, in the COMPO image, the silicon steel sheet can be identified as a light color, the intermediate layer can be identified as a dark color, and the insulation coating (the aluminum borate-based coating or the phosphoric acid-based coating) can be identified as a neutral color.

In order to specify each layer in the cross-sectional structure, using energy dispersive X-ray spectroscopy (SEM-EDS), line analysis is performed in the sheet thickness direction, and quantitative analysis of chemical components of each layer is performed. The elements to be quantitatively analyzed are 6 elements: Fe, P, Si, O, Mg, and Al. The device to be used is not particularly limited, but in the present embodiment, for example, SEM (NB5000 commercially available from Hitachi High-Technologies Corporation), EDS (XFlash® 6|30 commercially available from Bruker AXS), and EDS analysis software (ESPRIT1.9 commercially available from Bruker AXS) may be used.

Based on the observation results of COMPO images and quantitative analysis results of SEM-EDS described above, if there is a layered area present at the deepest position in the sheet thickness direction, which is an area in which the Fe content is 80 atom % or more and the O content is less than 30 atom % excluding measurement noise and the line segment (thickness) on the scan line for line analysis corresponding to this area is 300 nm or more, this area is determined as a silicon steel sheet, and an area excluding the silicon steel sheet is determined as an intermediate layer and an insulation coating (an aluminum borate-based coating or a phosphoric acid-based coating).

Regarding the area excluding the silicon steel sheet specified above, based on the observation results of COMPO images and quantitative analysis results of SEM-EDS, if there is an area in which the Fe content is less than 80 atom %, the P content is 5 atom % or more, and the O content is 30 atom % or more excluding measurement noise and the line segment (thickness) on the scan line for line analysis corresponding to this area is 300 nm or more, this area is determined as a phosphoric acid-based coating. Here, in addition to the above three elements which are determination elements for specifying the phosphoric acid-based coating, the phosphoric acid-based coating may contain aluminum, magnesium, nickel, manganese, or the like derived from a phosphate. In addition, silicon derived from colloidal silica and the like may be contained. Here, in the present embodiment, the phosphoric acid-based coating may not be provided.

Regarding the area excluding the silicon steel sheet and the phosphoric acid-based coating specified above, based on the observation results of COMPO images and quantitative analysis results of SEM-EDS, if there is an area in which the Fe content is less than 80 atom %, the P content is less than 5 atom %, the Si content is less than 20 atom %, the O content is 20 atom % or more, and the Al content is 10 atom % or more excluding measurement noise, and the line segment (thickness) on the scan line for line analysis corresponding to this area is 300 nm or more, this area is determined as an aluminum borate-based coating. Here, in addition to the five elements which are determination elements for specifying the aluminum borate-based coating, the aluminum borate-based coating contains boron. However, it may be difficult to accurately analyze the amount of boron by EDS quantitative analysis due to the influence of carbon and the like. Therefore, as necessary, EDS qualitative analysis may be performed in order to determine whether the aluminum borate-based coating contains boron. Here, in the present embodiment, the aluminum borate-based coating may not be provided.

When an area corresponding to the phosphoric acid-based coating or the aluminum borate-based coating is determined, precipitates, inclusions, voids and the like contained in each coating are not included as determination targets, and an area that satisfies the above quantitative analysis results as a matrix phase is determined as a phosphoric acid-based coating or an aluminum borate-based coating. For example, based on the COMPO images or line analysis results, if it is confirmed that precipitates, inclusions, voids and the like are present on the scan line for line analysis, this area is not included in the target, and determination is performed by quantitative analysis results as a matrix phase. Here, precipitates, inclusions, and voids can be distinguished from matrix phases by contrast in the COMPO images, and can be distinguished from matrix phases by the abundance of constituent elements in the quantitative analysis results. Here, when the phosphoric acid-based coating or the aluminum borate-based coating is specified, it is preferable to perform specification at a position on the scan line for line analysis in which precipitates, inclusions, and voids are not included.

If there is an area excluding the silicon steel sheet and the insulation coating (the aluminum borate-based coating or the phosphoric acid-based coating) specified above and the line segment (thickness) on the scan line for line analysis corresponding to this area is 300 nm or more, this area is determined as an intermediate layer. Here, in the present embodiment, the intermediate layer may not be provided.

The intermediate layer may satisfy, as an overall average, an average Fe content of less than 80 atom %, an average P content of less than 5 atom %, an average Si content of 20 atom % or more, and an average O content of 30 atom % or more. In addition, if the intermediate layer is not a forsterite coating but a silicon oxide film mainly containing silicon oxide, the average Mg content of the intermediate layer may be less than 20 atom %. Here, the quantitative analysis results of the intermediate layer are quantitative analysis results as a matrix phase, which do not include analysis results of precipitates, inclusions, voids, and the like contained in the intermediate layer. Here, when the intermediate layer is specified, it is preferable to perform specification at a position on the scan line for line analysis in which precipitates, inclusions, and voids are not included.

Specification of each layer and measurement of the thickness using the above COMPO image observation and SEM-EDS quantitative analysis are performed at five or more locations with different observation fields of view. For the thickness of each layer obtained at five or more locations in total, an average value is obtained from values excluding the maximum value and the minimum value, and this average value is used as an average thickness of each layer. However, for the thickness of the intermediate layer, thicknesses is measured at locations that can be determined as an external oxidation area and not an internal oxidation area while observing the morphology, and an average value of the thicknesses is obtained.

Here, if there is a layer in which the line segment (thickness) on the scan line for line analysis is less than 300 nm in at least one observation field of view at five or more locations described above, the corresponding layer is observed in detail under a TEM, and the corresponding layer is specified and the thickness thereof is measured using the TEM.

A test piece including a layer to be observed in detail using the TEM is cut out by focused ion beam (FIB) processing so that the cutting direction is parallel to the sheet thickness direction (specifically, a test piece is cut out so that the cut surface is parallel to the sheet thickness direction and perpendicular to the rolling direction), and the cross-sectional structure of the cut surface is observed (bright-field image) by scanning-TEM (STEM) at a magnification at which the corresponding layer is within the observation field of view. When each layer is not within the observation field of view, the cross-sectional structure is observed in a plurality of continuous fields of view.

In order to specify each layer in the cross-sectional structure, using TEM-EDS, line analysis is performed in the sheet thickness direction, and quantitative analysis of chemical components of each layer is performed. The elements to be quantitatively analyzed are 6 elements: Fe, P, Si, O, Mg, and Al. The device to be used is not particularly limited, but in the present embodiment, for example, TEM (JEM-2100F commercially available from JEOL Ltd.), EDS (JED-2300T commercially available from JEOL Ltd.), and EDS analysis software (AnalysisStation commercially available from JEOL Ltd.) may be used.

Based on the bright-field image observation results obtained by the TEM and the quantitative analysis results obtained by the TEM-EDS described above, each layer is specified and the thickness of each layer is measured. The method of specifying each layer and the method of measuring the thickness of each layer using the TEM may be performed according to the above method using the SEM.

Here, when the thickness of each layer specified using the TEM is 5 nm or less, it is preferable to use a TEM having a spherical aberration correction function in consideration of spatial resolution. In addition, when the thickness of each layer is 5 nm or less, point analysis is performed in the sheet thickness direction, for example, at intervals of 2 nm or less, the line segment (thickness) of each layer is measured, and this line segment may be used as the thickness of each layer. For example, when the TEM having a spherical aberration correction function is used, EDS analysis can be performed with a spatial resolution of about 0.2 nm.

Here, in the quantitative analysis results of the chemical components of the phosphoric acid-based coating specified by the above method, if the Fe content is less than 80 atom %, the P content is 5 atom % or more, and the O content is 30 atom % or more, it is determined that the phosphoric acid-based coating mainly contains a phosphorus silicon composite oxide.

Similarly, in the quantitative analysis results of the chemical components of the aluminum borate-based coating specified by the above method, if the Fe content is less than 80 atom %, the P content is less than 5 atom %, the Si content is less than 20 atom %, the O content is 20 atom % or more, and the Al content is 10 atom % or more, and boron is detected by qualitative analysis, it is determined that the aluminum borate-based coating mainly contains an aluminum/boron oxide.

Similarly, in the quantitative analysis results of the chemical components of the intermediate layer specified by the above method, if the average Fe content is less than 80 atom %, the average P content is less than 5 atom %, the average Si content is 20 atom % or more, the average O content is 30 atom % or more, and the average Mg content is less than 20 atom %, it is determined that the intermediate layer mainly contains silicon oxide.

In the following method, it is determined whether the aluminum borate-based coating contains aluminum oxide, $Al_{18}B_4O_{33}$, $Al_4B_2O_9$, boron oxide or the like. A sample is cut out from a grain-oriented electrical steel sheet, and as necessary, polishing is performed so that a surface parallel to the sheet surface becomes a measurement surface, the aluminum borate-based coating is exposed, and X-ray diffraction measurement is performed. For example, X-ray diffraction may be performed using CoKα rays (Kα1) as incident X rays. Based on X-ray diffraction patterns, it is identified whether there is aluminum oxide, $Al_{18}B_4O_{33}$, $Al_4B_2O_9$, boron oxide or the like.

The above identification may be performed using a Powder Diffraction File (PDF) of International Centre for Diffraction Data (ICDD). The identification of aluminum oxide may be performed based on PDF: No. 00-047-1770, or 00-056-1186. The identification of $Al_{18}B_4O_{33}$ may be performed based on PDF: No. 00-029-0009, 00-053-1233, or 00-032-0003. The identification of $Al_4B_2O_9$ may be performed based on PDF: No. 00-029-0010. The identification of boron oxide may be performed based on PDF: No. 00-044-1085, 00-024-0160, or 00-006-0634.

Next, a method of producing a grain-oriented electrical steel sheet according to the present embodiment will be described.

Here, the method of producing a grain-oriented electrical steel sheet according to the present embodiment is not limited to the following method. The following production method is one example for producing the grain-oriented electrical steel sheet according to the present embodiment.

For example, the method of producing a grain-oriented electrical steel sheet includes a casting process, a heating process, a hot rolling process, a hot-band annealing process, a hot-band pickling process, a cold rolling process, a decarburization annealing process, a nitriding process, an annealing separator applying process, a final annealing process, a surface treatment process, an intermediate layer forming process, an insulation coating forming process, and a magnetic domain controlling process.

Since the grain-oriented electrical steel sheet according to the present embodiment has surface properties of the silicon steel sheet as a base, among the above processes of producing the grain-oriented electrical steel sheet, it is particularly preferable to control four processes: the cold rolling process, the decarburization annealing process, the final annealing process, and the surface treatment process which affect the surface properties of the silicon steel sheet. Hereinafter, a preferable production method will be described in order from the casting process.

Casting Process

In the casting process, steel having the above chemical components may be melted in a converter furnace, an electric furnace or the like, and the molten steel may be used to produce a slab. A slab may be produced by a continuous casting method or an ingot may be produced using molten steel and the ingot may be bloomed to produce a slab. In addition, a slab may be produced by another method. The thickness of the slab is not particularly limited, and is, for example, 150 to 350 mm. The thickness of the slab is preferably 220 to 280 mm. A so-called thin slab with a thickness of 10 to 70 mm may be used as the slab.

Heating Process

In the heating process, the slab may be put into a well-known heating furnace or a well-known soaking furnace and heated. As one method of heating the slab, the slab may be heated at 1,280° C. or lower. When the heating temperature of the slab is set to 1,280° C. or lower, it is possible to avoid various problems (the need for a dedicated heating furnace, a large amount of molten scale, and the like) occurring, for example, when heating is performed at a temperature higher than 1,280° C. The lower limit value of the heating temperature of the slab is not particularly limited. When the heating temperature is too low, hot rolling may become difficult, and the productivity may decrease. Therefore, the heating temperature may be set in a range of 1,280° C. or lower in consideration of productivity. The preferable lower limit of the heating temperature of the slab is 1,100° C. The preferable upper limit of the heating temperature of the slab is 1,250° C.

In addition, as another method of heating a slab, the slab may be heated at a temperature of 1,320° C. or higher. When heating is performed at a high temperature of 1,320° C. or higher, AlN and Mn (S, Se) dissolve and finely precipitate in the subsequent process, and secondary recrystallization can be stably exhibited. Here, the slab heating process itself may be omitted and hot rolling may start after casting and before the slab temperature is lowered.

Hot Rolling Process

In the hot rolling process, the slab may be hot-rolled using a hot rolling mill. The hot rolling mill includes, for example, a rough rolling mill and a final rolling mill disposed downstream from the rough rolling mill. The heated steel is rolled with the rough rolling mill and then additionally rolled with the final rolling mill to produce a hot-rolled steel sheet. The final temperature (the steel sheet temperature on the outlet side of the final rolling stand that finally rolls the steel sheet with the final rolling mill) in the hot rolling process may be 700 to 1,150° C.

Hot-Band Annealing Process

In the hot-band annealing process, the hot-rolled steel sheet may be annealed (hot-band annealing). In the hot-band annealing, the non-uniform structure occurring during hot rolling is made as uniform as possible. The annealing conditions are not particularly limited as long as the non-uniform structure occurring during hot rolling can be made uniform. For example, the hot-rolled steel sheet is annealed under conditions of a soaking temperature of 750 to 1,200° C. and a soaking time of 30 to 600 seconds. Here, it is not always necessary to perform hot-band annealing, and a determination of whether the hot-band annealing process is performed may depend on characteristics required for the finally produced grain-oriented electrical steel sheet and production cost. In addition to make the structure uniform, in order to perform fine precipitation control of an AlN inhibitor, and control solid solution carbon and the second phase, two-step annealing, rapid cooling after annealing, and the like may be performed by a known method.

Hot-Band Pickling Process

In the hot-band pickling process, pickling may be performed in order to remove the scale generated on the surface of the hot-rolled steel sheet. Pickling conditions during hot-band pickling are not particularly limited, and pickling may be performed under known conditions.

Cold Rolling Process

In the cold rolling process, the hot-rolled steel sheet may be subjected to cold rolling once or twice or more with intermediate annealing therebetween. The final cold rolling reduction rate in cold rolling (cumulative cold rolling reduction rate without intermediate annealing or cumulative cold rolling reduction rate after intermediate annealing is performed) is preferably 80% or more and more preferably 90% or more. In addition, the final cold rolling reduction rate in cold rolling is preferably 95% or less. Here, the final cold rolling reduction rate (%) is defined as follows.

Cold rolling reduction rate (%)=(1−sheet thickness of steel sheet after final cold rolling/sheet thickness of steel sheet before final cold rolling)×100

In the present embodiment, in the surface properties of the rolling roll in the final pass (final stand) in cold rolling, the arithmetic average Ra is 0.40 μm or less, and more preferably, the average value ave-$AMP_{C100}$ of amplitudes in a wavelength range of 20 to 100 μm among the wavelength components obtained by performing Fourier analysis is 0.050 μm or less, and the rolling ratio in the final pass (final stand) is preferably 10% or more. When the rolling roll of the final pass is smoother and the rolling ratio of the final pass is larger, it ultimately becomes easier to smoothly control the surface of the silicon steel sheet. When the above conditions are satisfied in cold rolling and control conditions are satisfied in the postprocess, ave-$AMP_{C100}$ and the like of the silicon steel sheet can be suitably controlled.

Decarburization Annealing Process

In the decarburization annealing process, the cold-rolled steel sheet may be annealed in a decarburized atmosphere. Carbon in the steel sheet is removed by decarburization annealing and primary recrystallization also occurs. In the decarburization annealing, the oxidation degree ($PH_2O/PH_2$) in the annealing atmosphere (atmosphere in the furnace) may be 0.01 to 0.15, the soaking temperature may be 750 to 900° C., and the soaking time may be 10 to 600 seconds.

In the present embodiment, the conditions for decarburization annealing described above are controlled, and the amount of oxygen on the surface of the decarburized and annealed sheet is controlled such that it is 1 g/m$^2$ or less. For example, when the oxidation degree is high within the above range, the soaking temperature is lowered within the above range or the soaking time is shortened within the above range, and the amount of oxygen on the surface of the steel sheet may be 1 g/m$^2$ or less. In addition, for example, when the soaking temperature is high within the above range, the oxidation degree is lowered within the above range, or the soaking time is shortened within the above range, and the amount of oxygen on the surface of the steel sheet may be 1 g/m$^2$ or less. Here, even if pickling is performed using sulfuric acid, hydrochloric acid, or the like after decarburization annealing, it is not easy to control the amount of oxygen on the surface of the decarburized and annealed sheet such that it is 1 g/m$^2$ or less. It is preferable to control the amount of oxygen on the surface of the decarburized and annealed sheet by controlling the conditions for decarburization annealing described above.

The amount of oxygen on the surface of the decarburized and annealed sheet is preferably 0.8 g/m$^2$ or less. When the amount of oxygen is smaller, it ultimately becomes easier to smoothly control the surface of the silicon steel sheet. When the above conditions are satisfied in the decarburization annealing process and control conditions are satisfied in the preprocess and the postprocess, ave-AMP$_{C100}$ and the like of the silicon steel sheet can be suitably controlled.

Nitriding Process

In the nitriding process, the decarburized and annealed sheet may be annealed and nitrided in the atmosphere containing ammonia. This nitriding treatment may be continued immediately after decarburization annealing without lowering the temperature of the steel sheet after decarburization annealing to room temperature. When the nitriding treatment is performed, since fine inhibitors such as AlN and (Al, Si)N are produced in the steel, secondary recrystallization can be stably exhibited.

The nitriding treatment conditions are not particularly limited, but it is preferable to perform nitriding so that the nitrogen content in the steel increases by 0.003% or more before and after nitriding. The increment of nitrogen before and after nitriding is preferably 0.005% or more and more preferably 0.007% or more. When the increment of nitrogen before and after nitriding is more than 0.030%, the effect is maximized. Therefore, nitriding may be performed so that the increment of nitrogen is 0.030% or less.

Annealing Separator Applying Process

In the annealing separator applying process, an annealing separator containing $Al_2O_3$ and MgO is applied to the surface of the decarburized and annealed sheet, and the applied annealing separator may be dried. The annealing separator may be applied to the steel sheet surface by aqueous slurry coating, electrostatic coating, or the like.

When the annealing separator mainly contains MgO and the amount of $Al_2O_3$ is small, a forsterite coating is formed on the steel sheet during final annealing. On the other hand, when the annealing separator mainly contains $Al_2O_3$ and the amount of MgO is small, mullite ($3Al_2O_3.2SiO_2$) is formed on the steel sheet. Since theses forsterite and mullite hinder domain wall motion, iron loss characteristics of the grain-oriented electrical steel sheet deteriorate.

If an annealing separator containing $Al_2O_3$ and MgO in a preferable ratio is used, a steel sheet having a smooth surface without forming forsterite or mullite during final annealing can be obtained. For example, the annealing separator may contain 5 to 50% of MgO/(MgO+$Al_2O_3$) which is a mass ratio of MgO and $Al_2O_3$ and 1.5 mass % or less of hydration water.

Final Annealing Process

In the final annealing process, the cold-rolled steel sheet to which the annealing separator is applied may be subjected to final annealing. When the final annealing is performed, secondary recrystallization occurs, and the crystal orientation of the steel sheet accumulates in the {110}<001> orientation. In the heating procedure of final annealing, when the annealing atmosphere (the atmosphere in the furnace) contains hydrogen in order to stably perform secondary recrystallization, the oxidation degree ($PH_2O/PH_2$) is set to 0.0001 to 0.2, and in the case of an atmosphere containing an inert gas not containing hydrogen, the dew point may be 0° C. or lower.

In the present embodiment, regarding high temperature soaking conditions for final annealing, in an atmosphere containing 50% volume or more of hydrogen, the soaking temperature is 1,100 to 1,250° C. In addition, when the soaking temperature is 1,100 to 1,150° C., the soaking time is 30 hours or longer. In addition, when the soaking temperature is higher than 1,150 to 1,250° C., the soaking time is 10 hours or longer. When the soaking temperature is higher or the soaking time is longer, it ultimately becomes easier to smoothly control the surface of the silicon steel sheet. However, when the soaking temperature is higher than 1,250° C., equipment is expensive. When the above conditions are satisfied in the final annealing process and control conditions are satisfied in the preprocess and the postprocess, ave-AMP$_{C100}$ and the like of the silicon steel sheet can be suitably controlled.

Here, in the final annealing, elements such as Al, N, S, and Se contained as a steel composition in the cold-rolled steel sheet are discharged and the steel sheet is purified.

Surface Treatment Process

In the surface treatment process, the steel sheet after final annealing (finally annealed steel sheet) may be pickled and then washed with water. The pickling treatment and washing with water are performed to remove an excess annealing separator that did not react with steel from the surface of the steel sheet, and the surface properties of the steel sheet can be suitably controlled. Here, the steel sheet after the surface treatment process is a silicon steel sheet as a base of the grain-oriented electrical steel sheet.

In the present embodiment, regarding pickling conditions for the surface treatment, a solution containing a total amount of less than 20 mass % of one or two or more of sulfuric acid, hydrochloric acid, phosphoric acid, nitric acid, chloric acid, a chromium oxide aqueous solution, chromium sulfuric acid, permanganate, peroxosulfuric acid and peroxophosphate is preferably used. 10 mass % or less is more preferable. Using this solution, pickling is performed under conditions of a high temperature and a short time. Specifically, pickling is performed when the temperature of the solution is set to 50 to 80° C. and the immersion time is set to 1 to 30 seconds. When pickling is performed under such conditions, an excess annealing separator on the surface of the steel sheet can be efficiently removed and the surface properties of the steel sheet can be suitably controlled. Within the above range, when the acid concentration is lower, the liquid temperature is lower, and the immersion time is shorter, etch pits formed on the surface of the steel sheet are restricted and it ultimately becomes easier to smoothly control the surface of the silicon steel sheet. When the above conditions are satisfied in the surface treatment process and control conditions are satisfied in the preprocess, ave-AMP$_{C100}$ and the like of the silicon steel sheet can be suitably controlled. Here, conditions for washing with water in the surface treatment are not particularly limited, and washing may be performed under known conditions.

In the present embodiment, the grain-oriented electrical steel sheet including the silicon steel sheet produced above as a base may be produced. Specifically, a grain-oriented electrical steel sheet may be produced using a silicon steel sheet in which an average value of amplitudes in a wavelength range of 20 to 100 μm among the wavelength components obtained by performing Fourier analysis on the measured cross-sectional curve parallel to the sheet width direction is 0.0001 to 0.050 μm as a base. Preferably, an intermediate layer and an insulation coating may be formed on the sheet surface of the silicon steel sheet using the above silicon steel sheet as a base to produce a grain-oriented electrical steel sheet.

Intermediate Layer Forming Process

In the intermediate layer forming process, the above silicon steel sheet may be soaked in an atmospheric gas which contains hydrogen and has an oxidation degree ($PH_2O/PH_2$) that is adjusted to 0.00008 to 0.012 at a temperature range of 600° C. or higher and 1,150° C. or lower for 10 seconds or longer and 100 seconds or shorter. According to this heat treatment, an intermediate layer as an externally oxidized layer is formed on the surface of the silicon steel sheet.

Insulation Coating Forming Process

In the insulation coating forming process, an insulation coating (a phosphoric acid-based coating or an aluminum borate-based coating) may be formed on the silicon steel sheet on which the intermediate layer is formed.

When a phosphoric acid-based coating is formed, a composition for forming a phosphoric acid-based coating containing a mixture of colloidal silica, a phosphate such as a metal phosphate, and water is applied and baked. The composition for forming a phosphoric acid-based coating may contain 25 to 75 mass % of a phosphate and 75 to 25 mass % of colloidal silica in terms of anhydrous. The phosphate may be an aluminum salt, a magnesium salt, a nickel salt, a manganese salt or the like of phosphoric acid. The phosphoric acid-based coating is formed by baking the composition for forming a phosphoric acid-based coating at 350 to 600° C., and then heating at temperature of 800 to 1,000° C. During the heat treatment, as necessary, the oxidation degree and the dew point and the like of the atmosphere may be controlled.

When an aluminum borate-based coating is formed, a composition for forming an aluminum borate-based coating containing alumina sol and boric acid is applied and baked. The composition for forming an aluminum borate-based coating may have a composition ratio between alumina sol and boric acid that is 1.25 to 1.81 as an atomic ratio (Al/B) between aluminum and boric acid. The aluminum borate-based coating is formed by performing heating with a soaking temperature of 750 to 1,350° C. and a soaking time of 10 to 100 seconds. During the heat treatment, as necessary, the oxidation degree, the dew point and the like of the atmosphere may be controlled.

Magnetic Domain Controlling Process

In the magnetic domain controlling process, a treatment for refining the magnetic domain of the silicon steel sheet may be performed. When non-destructive stress strain is applied in a direction intersecting the rolling direction of the silicon steel sheet or a physical groove is formed, the magnetic domain of the silicon steel sheet can be refined. For example, the stress strain may be applied by laser beam irradiation, electron beam irradiation, or the like. The groove may be provided by a mechanical method such as a gear, a chemical method such as etching, or a thermal method such as laser irradiation.

When non-destructive stress strain is applied to the silicon steel sheet to refine the magnetic domain, it is preferable to control the magnetic domain after the insulation coating forming process. On the other hand, when a physical groove is formed in the silicon steel sheet to refine the magnetic domain, it is preferable to control the magnetic domain between the cold rolling process and the decarburization annealing process, between the decarburization annealing process (nitriding process) and the annealing separator applying process, between the intermediate layer forming process and the insulation coating forming process, or after the insulation coating forming process.

As described above, in the present embodiment, when conditions for four processes including the cold rolling process, the decarburization annealing process, the final annealing process, and the surface treatment process are controlled, the surface properties of the silicon steel sheet can be controlled. Since conditions for these four processes are each control conditions for controlling the surface properties of the silicon steel sheet, it is not enough to satisfy only one condition. Unless these conditions are controlled simultaneously and inseparably, ave-$AMP_{C100}$ of the silicon steel sheet cannot be satisfied.

Second Embodiment

In a grain-oriented electrical steel sheet according to the present embodiment, in addition to optimally controlling the surface properties of the silicon steel sheet in the sheet width direction (C direction), the surface properties of the silicon steel sheet in the rolling direction (L direction) are also optimally controlled.

For example, inside the transformer, when the magnetization direction matches the easy magnetization direction of the grain-oriented electrical steel sheet, the iron loss can be reduced. However, for example, in a 3-phase stacked transformer, since magnetization directions are orthogonal to each other in a T-shaped bonding part, even if a grain-oriented electrical steel sheet having excellent magnetic properties only in one direction is used, the iron loss may not be reduced as expected. Therefore, particularly, in the T-shaped bonding part, it is necessary to improve magnetic properties of the silicon steel sheet in the sheet width direction in addition to the rolling direction which is the easy magnetization direction of the silicon steel sheet.

Therefore, in the grain-oriented electrical steel sheet according to the present embodiment, in addition to the sheet width direction (C direction) of the silicon steel sheet, the surface properties are controlled in a wavelength range of 20 to 100 μm also in the rolling direction (L direction) of the silicon steel sheet.

Specifically, when the maximum value of amplitudes in a wavelength range of 20 to 100 μm among the wavelength components obtained by performing Fourier analysis on the measured cross-sectional curve parallel to the sheet width direction of the silicon steel sheet is set as max-$AMP_{C100}$ and the maximum value of amplitudes in a wavelength range of 20 to 100 μm among the wavelength components obtained by performing Fourier analysis on the measured cross-sectional curve parallel to the rolling direction of the silicon steel sheet is set as max-$AMP_{L100}$, max-$DIV_{100}$, which is a value obtained by dividing max-$AMP_{C100}$ by max-$AMP_{L100}$, is controlled such that it is 1.5 to 6.0.

Here, in the present embodiment, like the first embodiment, it is a prerequisite to control ave-$AMP_{C100}$ which corresponds to the surface properties of the silicon steel sheet in the sheet width direction. Then, surface properties in the rolling direction are also controlled. Therefore, the value of max-$DIV_{100}$ increases as the value of max-$AMP_{L100}$ in the rolling direction decreases with respect to max-$AMP_{C100}$ in the sheet width direction. When max-$DIV_{100}$ is 1.5 or more, it can be determined that surface properties are sufficiently controlled not only in the sheet width direction but also in the rolling direction. max-$DIV_{100}$ is preferably 2.0 or more and more preferably 3.0 or more.

On the other hand, the upper limit of max-$DIV_{100}$ is not particularly limited. However, it is not industrially easy to control surface properties in the rolling direction so that surface properties of the silicon steel sheet in the sheet width direction is controlled and max-$DIV_{100}$ is then larger than 6.0. Therefore, max-$DIV_{100}$ may be 6.0 or less.

In addition, when the maximum value of amplitudes in a wavelength range of 20 to 50 μm among the wavelength components obtained by performing Fourier analysis on the measured cross-sectional curve parallel to the sheet width direction of the silicon steel sheet is set as max-$AMP_{C50}$ and the maximum value of amplitudes in a wavelength range of 20 to 50 μm among the wavelength components obtained by performing Fourier analysis on the measured cross-sectional curve parallel to the rolling direction of the silicon steel sheet is set as max-$AMP_{L50}$, max-$DIV_{50}$, which is a value obtained by dividing max-$AMP_{C50}$ by max-$AMP_{L50}$, is controlled such that it is 1.5 to 5.0.

In order to suitably control surface properties in the rolling direction with respect to the sheet width direction, max-$DIV_{50}$ is preferably 2.0 or more and more preferably 3.0 or more. On the other hand, the upper limit of max-$DIV_{50}$ is not particularly limited. However, it is not industrially easy to control surface properties in the rolling direction so that the surface properties of the silicon steel sheet in the sheet width direction is controlled and max-$DIV_{50}$ is then larger than 5.0. Therefore, max-$DIV_{50}$ may be 5.0 or less.

Figure 3:
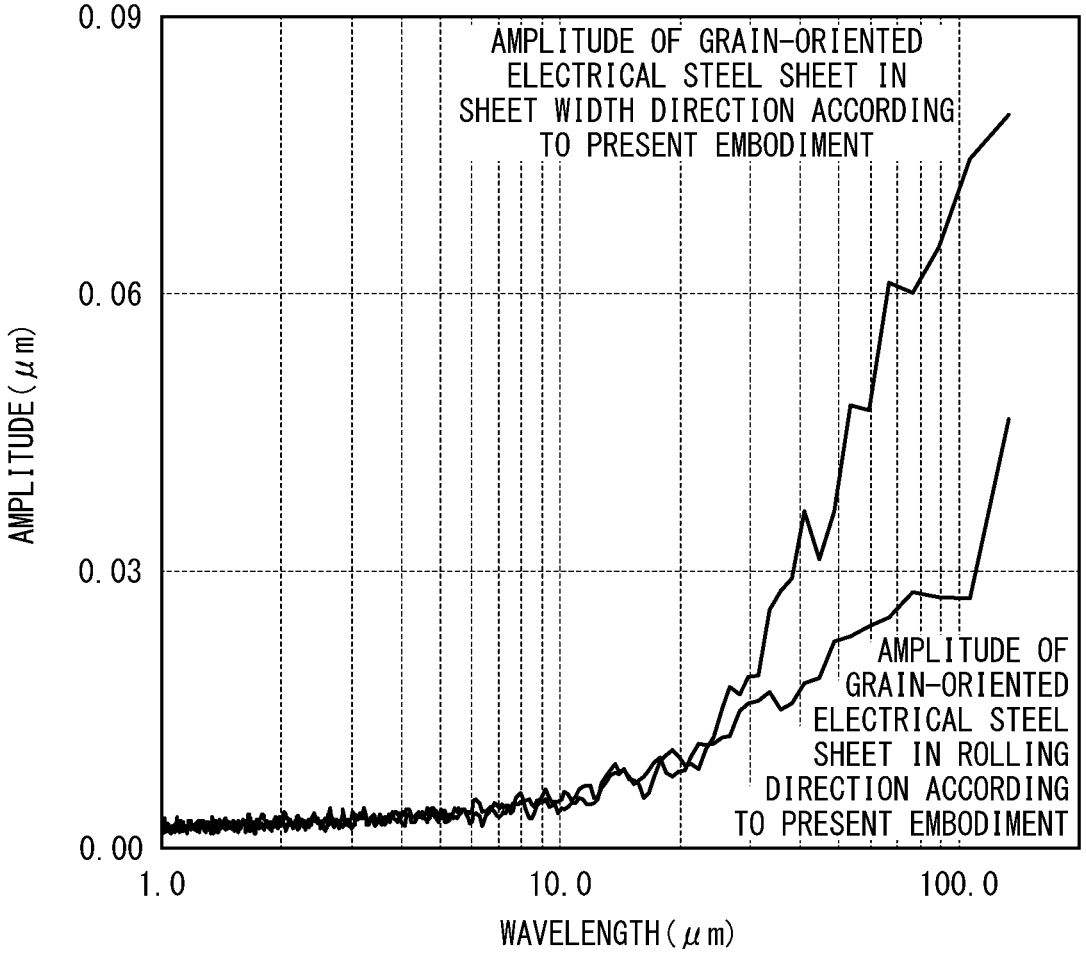
FIG. 3 shows a graph illustrating a plot of the amplitude with respect to the wavelength from Fourier analysis of a measured cross-sectional curve parallel to a sheet width direction and a rolling direction of a silicon steel sheet, regarding the grain-oriented electrical steel sheet according to the same embodiment.

FIG. 3 shows a graph illustrating a plot of the amplitude with respect to the wavelength from Fourier analysis of a measured cross-sectional curve parallel to a sheet width direction and a rolling direction of a silicon steel sheet (base steel sheet), regarding the grain-oriented electrical steel sheet according to the same embodiment. Generally, in the rolled steel sheet, it is more difficult to control surface properties in the sheet width direction than in the rolling direction. In the first embodiment, the surface properties of the silicon steel sheet in the sheet width direction are controlled. However, in the present embodiment, the surface properties of the silicon steel sheet in the rolling direction are also controlled in addition to the sheet width direction. That is, as shown in FIG. 3, regarding the wavelength range of 20 to 100 μm, the amplitude in the sheet width direction is optimized and the amplitude in the rolling direction is then reduced.

For example, ave-$AMP_{C100}$, max-$AMP_{C100}$, max-$AMP_{L100}$, ave-$AMP_{C50}$, max-$AMP_{C50}$, and max-$AMP_{L50}$ may be measured by the following method in the same manner as in the measurement method in the first embodiment.

When there is no coating on the silicon steel sheet, the surface properties of the silicon steel sheet may be evaluated directly, and when there is a coating on the silicon steel sheet, the surface properties of the silicon steel sheet may be evaluated after the coating is removed. For example, the grain-oriented electrical steel sheet having a coating may be immersed in an alkaline solution at a high temperature. Specifically, immersion into a sodium hydroxide aqueous solution containing NaOH: 20 mass %+$H_2O$: 80 mass % is performed at 80° C. for 20 minutes and washing with water and drying are then performed, and thus the coating (the intermediate layer and the insulation coating) on the silicon steel sheet can be removed. Here, the time for immersion in the sodium hydroxide aqueous solution may be changed according to the thickness of the coating on the silicon steel sheet.

Regarding the surface properties of the silicon steel sheet, in a contact type surface roughness measuring instrument, the contact needle tip radius is generally about micron (μm), and a fine surface shape cannot be detected. Therefore, it is preferable to use a non-contact type surface roughness measuring instrument. For example, a laser type surface roughness measuring instrument (VK-9700 commercially available from Keyence Corporation) may be used.

First, measured cross-sectional curves in the sheet width direction and the rolling direction of the silicon steel sheet are obtained using a non-contact type surface roughness measuring instrument. When these measured cross-sectional curves are obtained, one measurement length is 500 μm or more, and a total measurement length is 5 mm or more. The spatial resolution in the measurement direction (the sheet width direction of the silicon steel sheet) is 0.2 μm or less. The measured cross-sectional curves are subjected to Fourier analysis without applying a low pass or high pass filter to the measured cross-sectional curves, that is, without cutting off a specific wavelength component from the measured cross-sectional curves.

Among the wavelength components obtained by performing Fourier analysis on the measured cross-sectional curve, the average value and the maximum value of amplitudes in a wavelength range of 20 to 100 μm are obtained. The average value of amplitudes in the sheet width direction is set as ave-$AMP_{C100}$, the maximum value of amplitudes in the sheet width direction is set as max-$AMP_{C100}$, and the maximum value of amplitudes in the rolling direction is set as max-$AMP_{L100}$. Similarly, among the wavelength components obtained by performing Fourier analysis on the measured cross-sectional curve, the average value and the maximum value of amplitudes in a wavelength range of 20 to 50 μm are obtained. The average value of amplitudes in the sheet width direction is set as ave-$AMP_{C50}$, the maximum value of amplitudes in the sheet width direction is set as max-$AMP_{C50}$, and the maximum value of amplitudes in the rolling direction is set as max-$AMP_{L50}$. Here, the above measurement and analysis may be performed at five or more locations while changing measurement locations, and the average value thereof may be obtained In addition, max-$DIV_{100}$ is obtained by dividing max-$AMP_{C100}$ by max-$AMP_{L100}$ obtained above. Similarly, max-$DIV_{50}$ is obtained by dividing max-$AMP_{C50}$ by max-$AMP_{L50}$ obtained above.

In the present embodiment, ave-$AMP_{C100}$ is controlled and max-$DIV_{100}$ is then controlled to improve iron loss characteristics. In addition, as necessary, ave-$AMP_{C50}$ is controlled and max-$DIV_{50}$ is then controlled to suitably improve iron loss characteristics. A method of controlling these ave-$AMP_{C100}$ and max-$DIV_{100}$ will be described below.

In addition, in the grain-oriented electrical steel sheet according to the present embodiment, configurations other than the above surface properties are not particularly limited as in the first embodiment, descriptions thereof will be omitted here.

Next, a method of producing a grain-oriented electrical steel sheet according to the present embodiment will be described.

Here, the method of producing a grain-oriented electrical steel sheet according to the present embodiment is not limited to the following method. The following production method is one example for producing the grain-oriented electrical steel sheet according to the present embodiment.

For example, the method of producing a grain-oriented electrical steel sheet includes a casting process, a heating process, a hot rolling process, a hot-band annealing process, a hot-band pickling process, a cold rolling process, a decarburization annealing process, a nitriding process, an annealing separator applying process, a final annealing process, a surface treatment process, an intermediate layer forming process, an insulation coating forming process, and a magnetic domain controlling process.

However, since the casting process, the heating process, the hot rolling process, the hot-band annealing process, the hot-band pickling process, the nitriding process, the annealing separator applying process, the final annealing process, the intermediate layer forming process, the insulation coating forming process, and the magnetic domain controlling process are the same as those of the first embodiment, descriptions thereof will be omitted here.

Cold Rolling Process

In the cold rolling process according to the present embodiment, as in the first embodiment, the final cold rolling ratio in cold rolling (cumulative cold rolling ratio without intermediate annealing or cumulative cold rolling ratio after intermediate annealing is performed) is preferably 80% or more and more preferably 90% or more. In addition, the cold rolling ratio in final cold rolling is preferably 95% or less.

In the present embodiment, in the surface properties of the rolling roll in the final pass (final stand) in cold rolling, the arithmetic average Ra is 0.40 μm or less, and more preferably, the average value ave-$AMP_{C100}$ of amplitudes in a wavelength range of 20 to 100 μm among the wavelength components obtained by performing Fourier analysis is 0.050 μm or less, and the rolling ratio in the final pass (final stand) in cold rolling is preferably 15% or more. When the rolling roll of the final pass is smoother and the rolling ratio of the final pass is larger, it ultimately becomes easier to smoothly control the surface of the silicon steel sheet. When the above conditions are satisfied in cold rolling and control conditions are satisfied in the postprocess, ave-$AMP_{C100}$, max-$DIV_{100}$ and the like of the silicon steel sheet can be suitably controlled.

Decarburization Annealing Process

The same conditions as those of the first embodiment can be used as conditions of the oxidation degree, the soaking temperature, and the soaking time of the decarburization annealing process according to the present embodiment.

In addition, in the present embodiment, the conditions for decarburization annealing described above are controlled, and the amount of oxygen on the surface of the decarburized and annealed sheet is controlled such that it is 0.95 g/$m^2$ or less. For example, when the oxidation degree is high within the above range, the soaking temperature is lowered within the above range or the soaking time is shortened within the above range, and the amount of oxygen on the surface of the steel sheet may be 0.95 g/$m^2$ or less. In addition, for example, when the soaking temperature is high within the above range, the oxidation degree is lowered within the above range, or the soaking time is shortened within the above range, and the amount of oxygen on the surface of the steel sheet may be 0.95 g/$m^2$ or less. Here, even if pickling is performed using sulfuric acid, hydrochloric acid, or the like after decarburization annealing, it is not easy to control the amount of oxygen on the surface of the decarburized and annealed sheet such that it is 0.95 g/$m^2$ or less. It is preferable to control the amount of oxygen on the surface of the decarburized and annealed sheet by controlling the conditions for decarburization annealing described above.

The amount of oxygen on the surface of the decarburized and annealed sheet is preferably 0.75 g/$m^2$ or less. When the amount of oxygen is smaller, it ultimately becomes easier to smoothly control the surface of the silicon steel sheet. When the above conditions are satisfied in the decarburization annealing process and control conditions are satisfied in the preprocess and the postprocess, ave-$AMP_{C100}$, max-$DIV_{100}$ and the like of the silicon steel sheet can be suitably controlled.

Surface Treatment Process

In the present embodiment, regarding pickling conditions for the surface treatment, a solution containing a total amount of 0 to less than 10 mass % of one or two or more of sulfuric acid, hydrochloric acid, phosphoric acid, nitric acid, chloric acid, a chromium oxide aqueous solution, chromium sulfuric acid, permanganate, peroxosulfuric acid and peroxophosphate is preferably used. Using this solution, pickling is performed under conditions of a high temperature and a short time. Specifically, pickling is performed when the temperature of the solution is set to 50 to 80° C. and the immersion time is set to 1 to 30 seconds. When pickling is performed under such conditions, an excess annealing separator on the surface of the steel sheet can be efficiently removed and the surface properties of the steel sheet can be suitably controlled. Within the above range, when the acid concentration is lower, the liquid temperature is lower, and the immersion time is shorter, etch pits formed on the surface of the steel sheet are restricted and it ultimately becomes easier to smoothly control the surface of the silicon steel sheet. When the above conditions are satisfied in the surface treatment process and control conditions are satisfied in the preprocess, ave-$AMP_{C100}$, max-$DIV_{100}$ and the like of the silicon steel sheet can be suitably controlled. Here, conditions for washing with water in the surface treatment are not particularly limited, and washing may be performed under known conditions.

In addition, in addition to the above pickling treatment and washing with water, the surface properties of the steel sheet may be controlled using a brush roll. For example, during brushing, an SiC having a 100th to 500th abrasive grain size is used as an abrasive material, the brush rolling reduction is 1.0 mm to 5.0 mm, and the brush rotational speed is 500 to 1,500 rpm. In particular, when it is desired to control the surface properties of the silicon steel sheet in the sheet width direction, brushing may be performed so that the rotation axis is in the rolling direction. On the other hand, when it is desired to control the surface properties of the silicon steel sheet in the rolling direction, brushing may be performed so that the rotation axis is in the sheet width direction. In order to control surface properties in the sheet width direction and the rolling direction at the same time, brushing may be performed so that the rotation axis is in both the sheet width direction and the rolling direction. When brushing is performed so that the rotation axis is in the sheet width direction (direction orthogonal to the rolling direction), max-$DIV_{100}$ of the silicon steel sheet can be suitably controlled.

When the above conditions are satisfied in the surface treatment process and control conditions are satisfied in the preprocess, ave-$AMP_{C100}$, max-$DIV_{100}$ and the like of the silicon steel sheet can be suitably controlled. Here, conditions for washing with water in the surface treatment are not particularly limited, and washing may be performed under known conditions.

In the present embodiment, the grain-oriented electrical steel sheet including the silicon steel sheet produced above as a base may be produced. Specifically, a grain-oriented electrical steel sheet may be produced using a silicon steel sheet having an ave-$AMP_{C100}$ of 0.0001 to 0.050 μm and max-$DIV_{100}$ of 1.5 to 6.0 as a base. Preferably, an intermediate layer and an insulation coating may be formed on the sheet surface of the silicon steel sheet using the above silicon steel sheet as a base to produce a grain-oriented electrical steel sheet.

In the present embodiment, when conditions for the above processes are controlled, the surface properties of the silicon steel sheet can be controlled. Since conditions for these processes are each control conditions for controlling the surface properties of the silicon steel sheet, it is not enough to satisfy only one condition. Unless these conditions are controlled simultaneously and inseparably, ave-$AMP_{C100}$, max-$DIV_{100}$ and the like of the silicon steel sheet cannot be satisfied at the same time.

Example 1

Next, effects of one aspect of the present invention will be described in more detail with reference to examples, but conditions in the examples are one condition example used for confirming the feasibility and effects of the present invention, and the present invention is not limited to this one condition example. In the present invention, various conditions can be used without departing from the gist of the present invention and as long as the object of the present invention can be achieved.

Molten steel having adjusted steel components was cast to produce a slab. The slab was heated at 1,150° C., hot-rolled to have a sheet thickness of 2.6 mm, hot-band annealed in two steps at 1,120° C.+900° C., quenched after the hot-band annealing, pickled, cold-rolled to have a sheet thickness of 0.23 mm, decarburized and annealed, and nitrided and annealed so that the increment of nitrogen was 0.020%, and an annealing separator containing $Al_2O_3$ and MgO was applied, final annealing was performed, and a surface treatment was then performed by pickling and washing with water.

As production conditions, detailed conditions of the cold rolling process, the decarburization annealing process, the final annealing process, and the surface treatment process are shown in Table 1 to Table 3. In the cold rolling process, regarding the final pass (final stand) of cold rolling, the rolling ratio and the roll roughness Ra were changed. In the decarburization annealing process, the oxidation degree ($PH_2O/PH_2$) in the atmosphere, the soaking temperature, and the soaking time were changed, and the amount of oxygen on the surface of the decarburized and annealed sheet was controlled. Here, in the test No. 20, the oxidation degree in the atmosphere was 0.15, but the soaking temperature was 880° C., and the soaking time was 550 seconds, and thus the amount of oxygen on the surface of the decarburized and annealed sheet could not be controlled such that it is 1 g/$m^2$ or less. In the test No. 17, pickling was performed using sulfuric acid immediately after the decarburization annealing process, but the amount of oxygen on the surface of the decarburized and annealed sheet could not be controlled such that it is 1 g/$m^2$ or less.

In addition, in the final annealing process, an atmosphere containing 50 volume % or more of hydrogen was used, and the soaking time was changed according to the soaking temperature. In the surface treatment process, the acid concentration, the liquid temperature, and the immersion time were changed for the pickling treatment. Here, in the test No. 23, only washing with water was performed without performing the pickling treatment.

As the production results, the chemical components of the silicon steel sheets and the surface properties of the silicon steel sheets are shown in Table 4 to Table 9. Here, the chemical components and the surface properties of the silicon steel sheets were determined based on the above method.

In the tables, "-" in the chemical component of the silicon steel sheet indicates that the alloying element is not intentionally added or the content is below the measurement detection lower limit. In the tables, underlined values indicate that they are outside the scope of the present invention. Here, all of the silicon steel sheets had no forsterite coating and had a texture developed in the {110}<001> orientation.

Using the produced silicon steel sheet as a base, on the sheet surface of the silicon steel sheet, an intermediate layer was formed and an insulation coating was formed, and magnetic domain control was performed to produce a grain-oriented electrical steel sheet, and iron loss characteristics were evaluated. Here, the intermediate layer was formed by performing a heat treatment in an atmosphere having an oxidation degree ($PH_2O/PH_2$) of 0.0012 at 850° C. for 30 seconds. These intermediate layers mainly contained silicon oxide and had an average thickness of 25 nm.

In addition, in the test Nos. 1 to 10 and test Nos. 21 to 30, a phosphoric acid-based coating was formed as an insulation coating. The phosphoric acid-based coating was formed by applying a composition for forming a phosphoric acid-based coating containing a mixture of colloidal silica, a phosphate of aluminum salt or magnesium salt, and water, and performing a heat treatment under general conditions. These phosphoric acid-based coatings mainly contained a phosphorus silicon composite oxide and had an average thickness of 2 μm.

In addition, In the test Nos. 11 to 20 and test Nos. 31 to 42, an aluminum borate-based coating was formed as an insulation coating. The aluminum borate-based coating was formed by applying a composition for forming an aluminum borate-based coating containing alumina sol and boric acid and performing a heat treatment under general conditions. These aluminum borate-based coatings mainly contained aluminum/boron oxide and had an average thickness of 2 μm.

In addition, in all of the grain-oriented electrical steel sheets, after the insulation coating was formed, a laser beam was irradiated, and non-destructive stress strain was applied to refine the magnetic domain.

The iron loss was evaluated by a single sheet tester (SST). A sample with a width of 60 mm and a length of 300 mm was collected from the produced grain-oriented electrical steel sheet so that the long side of the test piece was in the rolling direction, and W17/50 (the iron loss when the steel sheet was magnetized with a magnetic flux density of 1.7 T at 50 Hz) was measured. When W17/50 was 0.68 W/kg or less, it was determined that the iron loss was favorable.

As shown in Table 1 to Table 9, in the examples of the present invention, since the surface properties of the silicon steel sheets were suitably controlled, the iron loss characteristics of the grain-oriented electrical steel sheets were excellent. On the other hand, in the comparative examples, since the surface properties of the silicon steel sheets were not suitably controlled, the iron loss characteristics of the grain-oriented electrical steel sheets were not satisfied. Here, although not shown in the tables, for example, in the test No. 5, in the sheet width direction of the silicon steel sheet, the surface roughness Ra was 0.4 μm or less when the cutoff wavelength λc was 800 μm, and the surface roughness Ra was 0.2 μm or less when the cutoff wavelength λc was 20 μm, but ave-$AMP_{C100}$ was more than 0.050 μm. In addition, in the test No. 39 and test No. 40, in the sheet width direction of the silicon steel sheet, the surface roughness Ra was also 0.03 μm when the cutoff wavelength λc was 250 μm, but in the test No. 39, ave-$AMP_{C100}$ was 0.020 μm or less, and in the test No. 40, ave-$AMP_{C100}$ was more than 0.020 μm.

TABLE 1

| | Production conditions | | | | | | | | | |
|---|---|---|---|---|---|---|---|---|---|---|
| | Cold rolling process | | Decarburization annealing process | | Final annealing process | | Surface treatment process | | | |
| | Final pass reduction rate % | Final pass roll roughness Ra μm | Atmosphere oxidation degree | Surface oxygen amount g/m$^2$ | Soaking temperature ° C. | Soaking time hour | Type of treatment solution | Concentration of treatment solution mass % | Liquid temperature of treatment solution ° C. | Immersion time sec |
| Test 1 | 5 | 0.5 | 0.25 | 1.36 | 1,100 | 15 | Sulfuric acid | 30 | 90 | 90 |
| Test 2 | 5 | 0.5 | 0.15 | 0.98 | 1,200 | 10 | Sulfuric acid | 25 | 90 | 60 |
| Test 3 | 5 | 0.5 | 0.15 | 0.98 | 1,200 | 20 | Sulfuric acid | 20 | 90 | 60 |
| Test 4 | 5 | 0.4 | 0.15 | 0.98 | 1,200 | 20 | Sulfuric acid | 20 | 90 | 60 |
| Test 5 | 5 | 0.4 | 0.15 | 0.98 | 1,200 | 20 | Sulfuric acid | 10 | 80 | 30 |
| Test 6 | 10 | 0.4 | 0.10 | 0.92 | 1,200 | 20 | Sulfuric acid | 3 | 80 | 30 |
| Test 7 | 20 | 0.1 | 0.10 | 0.92 | 1,200 | 20 | Sulfuric acid | 0.50 | 70 | 15 |
| Test 8 | 20 | 0.1 | 0.10 | 0.92 | 1,200 | 20 | Sulfuric acid | 5 | 70 | 15 |
| Test 9 | 30 | 0.0025 | 0.09 | 0.88 | 1,150 | 30 | Sulfuric acid | 0.50 | 70 | 30 |
| Test 10 | 30 | 0.1 | 0.09 | 0.88 | 1,250 | 10 | Sulfuric acid | 0.50 | 70 | 15 |
| Test 11 | 20 | 0.1 | 0.09 | 0.88 | 1,200 | 20 | Hydrochloric acid | 5 | 70 | 15 |
| Test 12 | 20 | 0.1 | 0.09 | 0.88 | 1,200 | 20 | Hydrochloric acid | 5 | 60 | 15 |
| Test 13 | 20 | 0.1 | 0.09 | 0.88 | 1,200 | 20 | Hydrochloric acid | 0.50 | 70 | 15 |
| Test 14 | 20 | 0.1 | 0.09 | 0.88 | 1,200 | 20 | Sulfuric acid + phosphoric acid | 3 + 1 | 70 | 15 |

TABLE 2

| | Production conditions | | | | | | | | | |
|---|---|---|---|---|---|---|---|---|---|---|
| | Cold rolling process | | Decarburization annealing process | | Final annealing process | | Surface treatment process | | | |
| | Final pass reduction rate % | Final pass roll roughness Ra μm | Atmosphere oxidation degree | Surface oxygen amount g/m$^2$ | Soaking temperature ° C. | Soaking time hour | Type of treatment solution | Concentration of treatment solution mass % | Liquid temperature of treatment solution ° C. | Immersion time sec |
| Test 15 | 20 | 0.1 | 0.09 | 0.88 | 1,200 | 20 | Sulfuric acid | 0.50 | 70 | 15 |
| Test 16 | 5 | 0.5 | 0.10 | 0.92 | 1,200 | 20 | Sulfuric acid | 3 | 80 | 30 |
| Test 17 | 10 | 0.4 | 0.17 | 1.07 | 1,200 | 20 | Sulfuric acid | 7.5 | 80 | 30 |
| Test 18 | 10 | 0.4 | 0.10 | 0.92 | 1,200 | 20 | Sulfuric acid | 25 | 80 | 60 |
| Test 19 | 10 | 0.5 | 0.10 | 0.92 | 1,200 | 20 | Sulfuric acid | 7.5 | 80 | 30 |
| Test 20 | 10 | 0.4 | 0.15 | 1.10 | 1,200 | 20 | Sulfuric acid | 7.5 | 80 | 30 |
| Test 21 | 10 | 0.4 | 0.15 | 0.98 | 1,100 | 20 | Sulfuric acid | 7.5 | 80 | 30 |
| Test 22 | 10 | 0.4 | 0.10 | 0.92 | 1,200 | 5 | Sulfuric acid | 7.5 | 80 | 30 |
| Test 23 | 10 | 0.4 | 0.10 | 0.92 | 1,200 | 20 | Not applied | Not applied | Not applied | Not applied |
| Test 24 | 10 | 0.4 | 0.15 | 0.98 | 1,200 | 20 | Sulfuric acid | 7.5 | 25 | 30 |
| Test 25 | 10 | 0.4 | 0.10 | 0.92 | 1,200 | 20 | Sulfuric acid | 25 | 50 | 30 |
| Test 26 | 20 | 0.1 | 0.09 | 0.89 | 1,200 | 20 | Sulfuric acid | 0.50 | 60 | 30 |
| Test 27 | 20 | 0.1 | 0.09 | 0.90 | 1,200 | 20 | Sulfuric acid | 0.50 | 60 | 30 |
| Test 28 | 20 | 0.1 | 0.09 | 0.88 | 1,200 | 20 | Sulfuric acid | 0.50 | 60 | 30 |

TABLE 3

| | Production conditions | | | | | | | | | |
|---|---|---|---|---|---|---|---|---|---|---|
| | Cold rolling process | | Decarburization annealing process | | Final annealing process | | Surface treatment process | | | |
| | Final pass reduction rate % | Final pass roll roughness Ra μm | Atmosphere oxidation degree | Surface oxygen amount g/m$^2$ | Soaking temperature ° C. | Soaking time hour | Type of treatment solution | Concentration of treatment solution mass % | Liquid temperature of treatment solution ° C. | Immersion time sec |
| Test 29 | 20 | 0.1 | 0.09 | 0.89 | 1,200 | 20 | Sulfuric acid | 0.50 | 60 | 30 |
| Test 30 | 20 | 0.1 | 0.09 | 0.87 | 1,200 | 20 | Sulfuric acid | 0.50 | 60 | 30 |

TABLE 3-continued

| | Production conditions | | | | | | | | | |
|---|---|---|---|---|---|---|---|---|---|---|
| | Cold rolling process | | Decarburization annealing process | | Final annealing process | | Surface treatment process | | | |
| | Final pass reduction rate % | Final pass roll roughness Ra μm | Atmosphere oxidation degree | Surface oxygen amount g/m$^2$ | Soaking temperature ° C. | Soaking time hour | Type of treatment solution | Concentration of treatment solution mass % | Liquid temperature of treatment solution ° C. | Immersion time sec |
| Test 31 | 20 | 0.1 | 0.09 | 0.87 | 1,200 | 20 | Sulfuric acid | 0.50 | 60 | 30 |
| Test 32 | 20 | 0.1 | 0.09 | 0.89 | 1,200 | 20 | Sulfuric acid | 0.50 | 60 | 30 |
| Test 33 | 20 | 0.1 | 0.09 | 0.88 | 1,200 | 20 | Sulfuric acid | 0.50 | 60 | 30 |
| Test 34 | 20 | 0.1 | 0.09 | 0.89 | 1,200 | 20 | Sulfuric acid | 0.50 | 60 | 30 |
| Test 35 | 20 | 0.1 | 0.09 | 0.88 | 1,200 | 20 | Sulfuric acid | 0.50 | 60 | 30 |
| Test 36 | 20 | 0.1 | 0.09 | 0.87 | 1,200 | 20 | Sulfuric acid | 0.50 | 60 | 30 |
| Test 37 | 20 | 0.1 | 0.09 | 0.88 | 1,200 | 20 | Sulfuric acid | 0.50 | 60 | 30 |
| Test 38 | 20 | 0.1 | 0.09 | 0.90 | 1,200 | 20 | Sulfuric acid | 0.50 | 60 | 30 |
| Test 39 | 30 | 0.1 | 0.02 | 0.30 | 1,250 | 30 | Sulfuric acid | 0.30 | 70 | 15 |
| Test 40 | 25 | 0.1 | 0.01 | 0.35 | 1,250 | 30 | Sulfuric acid | 0.30 | 60 | 15 |
| Test 41 | 8 | 0.4 | 0.10 | 0.92 | 1,150 | 30 | Sulfuric acid | 3 | 70 | 15 |
| Test 42 | 10 | 0.4 | 0.10 | 0.92 | 1,150 | 30 | Sulfuric acid | 10 | 70 | 15 |

TABLE 4

| | Production results | | | | | | | | | | | | | | | | | | |
|---|---|---|---|---|---|---|---|---|---|---|---|---|---|---|---|---|---|---|---|
| | Component composition of silicon steel sheet (unit: mass %, remainder being Fe and impurities) | | | | | | | | | | | | | | | | | | |
| | Si | Mn | Cr | Cu | P | Sn | Sb | Ni | B | V | Nb | Mo | Ti | Bi | Al | C | N | S | Se |
| Test 1 | 3.2 | — | — | — | — | — | — | — | — | — | — | — | — | — | 0.001 | 0.0004 | 0.0022 | 0.0027 | — |
| Test 2 | 3.2 | — | — | — | — | — | — | — | — | — | — | — | — | — | 0.001 | 0.0008 | 0.0012 | 0.0025 | — |
| Test 3 | 3.2 | — | — | — | — | — | — | — | — | — | — | — | — | — | 0.001 | 0.0008 | 0.0010 | 0.0014 | — |
| Test 4 | 3.2 | — | — | — | — | — | — | — | — | — | — | — | — | — | 0.001 | 0.0008 | 0.0011 | 0.0014 | — |
| Test 5 | 3.2 | — | — | — | — | — | — | — | — | — | — | — | — | — | 0.001 | 0.0008 | 0.0010 | 0.0014 | — |
| Test 6 | 3.2 | — | — | — | — | — | — | — | — | — | — | — | — | — | 0.001 | 0.0011 | 0.0009 | 0.0014 | — |
| Test 7 | 3.2 | — | — | — | — | — | — | — | — | — | — | — | — | — | 0.001 | 0.0011 | 0.0010 | 0.0014 | — |
| Test 8 | 3.2 | — | — | — | — | — | — | — | — | — | — | — | — | — | 0.001 | 0.0011 | 0.0011 | 0.0013 | — |
| Test 9 | 3.2 | — | — | — | — | — | — | — | — | — | — | — | — | — | 0.001 | 0.0012 | 0.0013 | 0.0025 | — |
| Test 10 | 3.2 | — | — | — | — | — | — | — | — | — | — | — | — | — | 0.001 | 0.0010 | 0.0004 | 0.0012 | — |
| Test 11 | 3.2 | — | — | — | — | — | — | — | — | — | — | — | — | — | 0.001 | 0.0013 | 0.0009 | 0.0014 | — |
| Test 12 | 3.2 | — | — | — | — | — | — | — | — | — | — | — | — | — | 0.001 | 0.0013 | 0.0010 | 0.0013 | — |
| Test 13 | 3.2 | — | — | — | — | — | — | — | — | — | — | — | — | — | 0.001 | 0.0013 | 0.0009 | 0.0014 | — |
| Test 14 | 3.2 | — | — | — | — | — | — | — | — | — | — | — | — | — | 0.001 | 0.0013 | 0.0008 | 0.0014 | — |

TABLE 5

| | Production results | | | | | | | | | | | | | | | | | | |
|---|---|---|---|---|---|---|---|---|---|---|---|---|---|---|---|---|---|---|---|
| | Component composition of silicon steel sheet (unit: mass %, remainder being Fe and impurities) | | | | | | | | | | | | | | | | | | |
| | Si | Mn | Cr | Cu | P | Sn | Sb | Ni | B | V | Nb | Mo | Ti | Bi | Al | C | N | S | Se |
| Test 15 | 3.2 | — | — | — | — | — | — | — | — | — | — | — | — | — | 0.001 | 0.0013 | 0.0010 | 0.0014 | — |
| Test 16 | 3.2 | — | — | — | — | — | — | — | — | — | — | — | — | — | 0.001 | 0.0010 | 0.0009 | 0.0013 | — |
| Test 17 | 3.2 | — | — | — | — | — | — | — | — | — | — | — | — | — | 0.001 | 0.0007 | 0.0010 | 0.0014 | — |
| Test 18 | 3.2 | — | — | — | — | — | — | — | — | — | — | — | — | — | 0.001 | 0.0010 | 0.0010 | 0.0014 | — |
| Test 19 | 3.2 | — | — | — | — | — | — | — | — | — | — | — | — | — | 0.001 | 0.0008 | 0.0006 | 0.0013 | — |
| Test 20 | 3.2 | — | — | — | — | — | — | — | — | — | — | — | — | — | 0.001 | 0.0008 | 0.0006 | 0.0013 | — |
| Test 21 | 3.2 | — | — | — | — | — | — | — | — | — | — | — | — | — | 0.001 | 0.0007 | 0.0006 | 0.0013 | — |
| Test 22 | 3.2 | — | — | — | — | — | — | — | — | — | — | — | — | — | 0.001 | 0.0007 | 0.0007 | 0.0014 | — |
| Test 23 | 3.2 | — | — | — | — | — | — | — | — | — | — | — | — | — | 0.001 | 0.0008 | 0.0006 | 0.0014 | — |
| Test 24 | 3.2 | — | — | — | — | — | — | — | — | — | — | — | — | — | 0.001 | 0.0009 | 0.0005 | 0.0014 | — |
| Test 25 | 3.2 | — | — | — | — | — | — | — | — | — | — | — | — | — | 0.001 | 0.0008 | 0.0006 | 0.0013 | — |
| Test 26 | 3.3 | 0.1 | — | — | — | — | — | — | — | — | — | — | — | — | 0.001 | 0.0008 | 0.0006 | 0.0014 | — |
| Test 27 | 3.3 | — | 0.1 | — | — | — | — | — | — | — | — | — | — | — | 0.001 | 0.0009 | 0.0011 | 0.0007 | 0.0017 |
| Test 28 | 3.3 | — | — | 0.1 | — | — | — | — | — | — | — | — | — | — | 0.001 | 0.0012 | 0.0010 | 0.0014 | — |

TABLE 6

| | Production results | | | | | | | | | | | | | | | | | | |
|---|---|---|---|---|---|---|---|---|---|---|---|---|---|---|---|---|---|---|---|
| | Component composition of silicon steel sheet (unit: mass %, remainder being Fe and impurities) | | | | | | | | | | | | | | | | | | |
| | Si | Mn | Cr | Cu | P | Sn | Sb | Ni | B | V | Nb | Mo | Ti | Bi | Al | C | N | S | Se |
| Test 29 | 3.3 | — | — | — | 0.01 | — | — | — | — | — | — | — | — | — | 0.001 | 0.0008 | 0.0006 | 0.0014 | — |
| Test 30 | 3.3 | — | — | — | — | 0.05 | — | — | — | — | — | — | — | — | 0.001 | 0.0008 | 0.0011 | 0.0006 | 0.0017 |
| Test 31 | 3.3 | — | — | — | — | — | 0.03 | — | — | — | — | — | — | — | 0.001 | 0.0009 | 0.0009 | 0.0014 | — |
| Test 32 | 3.3 | — | — | — | — | — | — | 0.05 | — | — | — | — | — | — | 0.001 | 0.0013 | 0.0010 | 0.0009 | 0.0016 |
| Test 33 | 3.3 | — | — | — | — | — | — | — | 0.002 | — | — | — | — | — | 0.001 | 0.0013 | 0.0011 | 0.0008 | 0.0015 |
| Test 34 | 3.3 | — | — | — | — | — | — | — | — | 0.02 | — | — | — | — | 0.002 | 0.0014 | 0.0010 | 0.0014 | — |
| Test 35 | 3.3 | — | — | — | — | — | — | — | — | | 0.03 | — | — | — | 0.001 | 0.0013 | 0.0009 | 0.0013 | — |
| Test 36 | 3.3 | — | — | — | — | — | — | — | — | — | — | 0.02 | — | — | 0.001 | 0.0008 | 0.0006 | 0.0014 | — |
| Test 37 | 3.3 | — | — | — | — | — | — | — | — | — | — | — | 0.005 | — | 0.001 | 0.0014 | 0.0009 | 0.0014 | — |
| Test 38 | 3.3 | — | — | — | — | — | — | — | — | — | — | — | — | 0.003 | 0.001 | 0.0013 | 0.0010 | 0.0008 | 0.0016 |
| Test 39 | 3.2 | — | — | — | — | — | — | — | — | — | — | — | — | — | 0.001 | 0.0017 | 0.0003 | 0.0008 | — |
| Test 40 | 3.2 | — | — | — | — | — | — | — | — | — | — | — | — | — | 0.001 | 0.0020 | 0.0004 | 0.0012 | — |
| Test 41 | 3.2 | — | — | — | — | — | — | — | — | — | — | — | — | — | 0.001 | 0.0010 | 0.0013 | 0.0014 | — |
| Test 42 | 3.2 | — | — | — | — | — | — | — | — | — | — | — | — | — | 0.001 | 0.0010 | 0.0012 | 0.0014 | — |

TABLE 7

| | Production results Surface properties of silicon steel sheet | | Evaluation results | |
|---|---|---|---|---|
| | ave-AMP$_{C100}$ μm | ave-AMP$_{C50}$ μm | Iron loss $W_{17/50}$ W/kg | Note |
| Test 1 | 0.247 | 0.234 | 0.79 | Comparative example |
| Test 2 | 0.137 | 0.130 | 0.74 | Comparative example |
| Test 3 | 0.060 | 0.044 | 0.72 | Comparative example |
| Test 4 | 0.059 | 0.043 | 0.71 | Comparative example |
| Test 5 | 0.052 | 0.038 | 0.70 | Comparative example |
| Test 6 | 0.049 | 0.036 | 0.68 | Example of present invention |
| Test 7 | 0.025 | 0.017 | 0.63 | Example of present invention |
| Test 8 | 0.033 | 0.024 | 0.66 | Example of present invention |
| Test 9 | 0.029 | 0.020 | 0.65 | Example of present invention |
| Test 10 | 0.023 | 0.016 | 0.62 | Example of present invention |
| Test 11 | 0.034 | 0.023 | 0.67 | Example of present invention |
| Test 12 | 0.028 | 0.019 | 0.63 | Example of present invention |
| Test 13 | 0.026 | 0.018 | 0.63 | Example of present invention |
| Test 14 | 0.031 | 0.021 | 0.67 | Example of present invention |

TABLE 8

| | Production results Surface properties of silicon steel sheet | | Evaluation results | |
|---|---|---|---|---|
| | ave-AMP$_{C100}$ μm | ave-AMP$_{C50}$ μm | Iron loss $W_{17/50}$ W/kg | Note |
| Test 15 | 0.026 | 0.018 | 0.63 | Example of present invention |
| Test 16 | 0.061 | 0.045 | 0.72 | Comparative example |
| Test 17 | 0.184 | 0.134 | 0.77 | Comparative example |
| Test 18 | 0.098 | 0.072 | 0.73 | Comparative example |
| Test 19 | 0.066 | 0.048 | 0.71 | Comparative example |
| Test 20 | 0.178 | 0.130 | 0.78 | Comparative example |
| Test 21 | 0.053 | 0.039 | 0.71 | Comparative example |
| Test 22 | 0.054 | 0.040 | 0.72 | Comparative example |
| Test 23 | 0.121 | 0.088 | 0.82 | Comparative example |
| Test 24 | 0.092 | 0.067 | 0.72 | Comparative example |

TABLE 8-continued

| | Production results Surface properties of silicon steel sheet | | Evaluation results | |
|---|---|---|---|---|
| | ave-AMP$_{C100}$ μm | ave-AMP$_{C50}$ μm | Iron loss $W_{17/50}$ W/kg | Note |
| Test 25 | 0.089 | 0.065 | 0.71 | Comparative example |
| Test 26 | 0.026 | 0.017 | 0.63 | Example of present invention |
| Test 27 | 0.025 | 0.017 | 0.63 | Example of present invention |
| Test 28 | 0.025 | 0.016 | 0.63 | Example of present invention |

TABLE 9

| | Production results Surface properties of silicon steel sheet | | Evaluation results | |
|---|---|---|---|---|
| | ave-AMP$_{C100}$ μm | ave-AMP$_{C50}$ μm | Iron loss $W_{17/50}$ W/kg | Note |
| Test 29 | 0.026 | 0.018 | 0.64 | Example of present invention |
| Test 30 | 0.023 | 0.016 | 0.62 | Example of present invention |
| Test 31 | 0.024 | 0.016 | 0.62 | Example of present invention |
| Test 32 | 0.026 | 0.018 | 0.63 | Example of present invention |
| Test 33 | 0.025 | 0.017 | 0.62 | Example of present invention |
| Test 34 | 0.026 | 0.018 | 0.64 | Example of present invention |
| Test 35 | 0.027 | 0.019 | 0.63 | Example of present invention |
| Test 36 | 0.025 | 0.017 | 0.63 | Example of present invention |
| Test 37 | 0.024 | 0.016 | 0.63 | Example of present invention |
| Test 38 | 0.025 | 0.017 | 0.62 | Example of present invention |
| Test 39 | 0.018 | 0.012 | 0.60 | Example of present invention |
| Test 40 | 0.021 | 0.014 | 0.61 | Example of present invention |
| Test 41 | 0.051 | 0.037 | 0.71 | Comparative example |
| Test 42 | 0.048 | 0.035 | 0.68 | Example of present invention |

Example 2

Molten steel having adjusted steel components was cast to produce a slab. The slab was heated at 1,150° C., hot-rolled to have a sheet thickness of 2.6 mm, hot-band annealed in two steps at 1,120° C.+900° C., quenched after the hot-band annealing, pickled, cold-rolled to have a sheet thickness of 0.23 mm, decarburized and annealed, and nitrided and annealed so that the increment of nitrogen was 0.020%, and an annealing separator containing $Al_2O_3$ and MgO was applied, final annealing was performed, and a surface treatment was then performed to perform at least one of pickling, washing with water, and brushing.

As production conditions, detailed conditions of the cold rolling process, the decarburization annealing process, the final annealing process, and the surface treatment process are shown in Table 10 to Table 13. In the cold rolling process, regarding the final pass (final stand) of cold rolling, the rolling ratio and the roll roughness Ra were changed. In the decarburization annealing process, the oxidation degree ($PH_2O/PH_2$) in the atmosphere, the soaking temperature, and the soaking time were changed, and the amount of oxygen on the surface of the decarburized and annealed sheet was controlled. Here, in the test No. 2-22, pickling was performed using sulfuric acid immediately after the decarburization annealing process, but the amount of oxygen on the surface of the decarburized and annealed sheet could not be controlled such that it is 1 g/m$^2$ or less.

In addition, in the final annealing process, an atmosphere containing 50 volume % or more of hydrogen was used, and the soaking time was changed according to the soaking temperature. In the surface treatment process, the acid concentration, the liquid temperature, and the immersion time were changed for the pickling treatment. Here, in the test No. 2-43, washing with water and brushing were performed without performing the pickling treatment.

As the production results, the chemical components of the silicon steel sheets and the surface properties of the silicon steel sheets are shown in Table 14 to Table 21. Here, the chemical components and the surface properties of the silicon steel sheets were determined based on the above method.

In the tables, "-" in the chemical component of the silicon steel sheet indicates that the alloying element is not intentionally added or the content is below the measurement detection lower limit. In the tables, underlined values indicate that they are outside the scope of the present invention. Here, all of the silicon steel sheets had no forsterite coating and had a texture developed in the {110}<001> orientation.

Using the produced silicon steel sheet as a base, on the sheet surface of the silicon steel sheet, an intermediate layer was formed and an insulation coating was formed, and magnetic domain control was performed to produce a grain-oriented electrical steel sheet, and iron loss characteristics were evaluated. Here, the intermediate layer was formed by performing a heat treatment in an atmosphere having an oxidation degree ($PH_2O/PH_2$) of 0.0012 at 850° C. for 30 seconds. These intermediate layers mainly contained silicon oxide and had an average thickness of 25 nm.

In addition, in the test Nos. 2-1 to 2-15 and test Nos. 2-31 to 2-40, a phosphoric acid-based coating was formed as an insulation coating. The phosphoric acid-based coating was formed by applying a composition for forming a phosphoric acid-based coating containing a mixture of colloidal silica, a phosphate of aluminum salt or magnesium salt, and water, and performing a heat treatment under general conditions. These phosphoric acid-based coatings mainly contained a phosphorus silicon composite oxide and had an average thickness of 2 μm.

In addition, in the test Nos. 2-16 to 2-30 and test Nos. 2-41 to 2-55, an aluminum borate-based coating was formed as an insulation coating. The aluminum borate-based coating was formed by applying a composition for forming an aluminum borate-based coating containing alumina sol and boric acid and performing a heat treatment under general conditions. These aluminum borate-based coatings mainly contained aluminum/boron oxide and had an average thickness of 2 μm.

In addition, in all of the grain-oriented electrical steel sheets, after the insulation coating was formed, a laser beam was irradiated, and non-destructive stress strain was applied to refine the magnetic domain.

The iron loss was evaluated by a single sheet tester (SST). A sample with a width of 60 mm and a length of 300 mm was collected from the produced grain-oriented electrical steel sheet so that the long side of the test piece was in the rolling direction and the sheet width direction, W17/50 (the iron loss when the steel sheet was magnetized with a magnetic flux density of 1.7 T at 50 Hz) was measured using the test piece in the rolling direction, and W6/50 (the iron loss when the steel sheet was magnetized with a magnetic flux density of 0.6 T at 50 Hz) was measured using the test piece in the sheet width direction. When the iron loss W17/50 in the rolling direction was 0.68 W/kg or less and the iron loss W6/50 in the sheet width direction was 0.80 W/kg or less, it was determined that the iron loss was favorable.

As shown in Table 10 to Table 21, in the examples of the present invention, since the surface properties of the silicon steel sheets were suitably controlled, the iron loss characteristics of the grain-oriented electrical steel sheets were excellent. On the other hand, in the comparative examples, since the surface properties of the silicon steel sheets were not suitably controlled, the iron loss characteristics of the grain-oriented electrical steel sheets were not satisfied. Here, although not shown in the tables, for example, in the test No. 2-3, in the sheet width direction of the silicon steel sheet, the surface roughness Ra was 0.4 μm or less when the cutoff wavelength λc was 800 μm, and the surface roughness Ra was 0.2 μm or less when the cutoff wavelength λc was 20 μm, but ave-$AMP_{C100}$ was more than 0.050 μm. In addition, in the test No. 2-54 and test No. 2-55, in the sheet width direction of the silicon steel sheet, the surface roughness Ra was also 0.03 μm when the cutoff wavelength λc was 250 μm, but in the test No. 2-54, ave-$AMP_{C100}$ was 0.020 μm or less, and in the test No. 2-55, ave-$AMP_{C100}$ was more than 0.020 μm.

TABLE 10

| | Production conditions | | | | | | | | | | | | | |
|---|---|---|---|---|---|---|---|---|---|---|---|---|---|---|
| | | | | | | | Surface treatment process | | | | | | | |
| | | | | | | | Pickling treatment | | | | Brushing treatment | | | |
| | Cold rolling process | | Decarburization annealing process | | Final annealing process | | Type | Concentration | Liquid temperature | | Done (Rotation | | Brush roll- | Brush |
| | Final pass reduction rate % | Final pass roll roughness Ra μm | Oxidation degree in atmosphere | Surface oxygen amount g/m² | Soaking temperature ° C. | Soaking time hour | of treatment solution | of treatment solution mass % | of treatment solution ° C. | Immersion time sec | axis direction)/ Not done | Abrasive grain size | ing reduction mm | rotational speed rpm |
| Test 2-1 | 5 | 0.5 | 0.15 | 0.98 | 1,200 | 20 | Sulfuric acid | 20 | 90 | 60 | Not done | — | — | — |
| Test 2-2 | 5 | 0.4 | 0.15 | 0.98 | 1,200 | 20 | Sulfuric acid | 20 | 90 | 60 | Not done | — | — | — |
| Test 2-3 | 5 | 0.4 | 0.15 | 0.98 | 1,200 | 20 | Sulfuric acid | 10 | 80 | 30 | Not done | — | — | — |
| Test 2-4 | 15 | 0.4 | 0.10 | 0.92 | 1,200 | 20 | Sulfuric acid | 3 | 80 | 30 | Sheet width direction | 500 | 3 | 750 |
| Test 2-5 | 15 | 0.4 | 0.10 | 0.92 | 1,200 | 20 | Sulfuric acid | 0.5 | 70 | 30 | Sheet width direction | 500 | 3 | 750 |
| Test 2-6 | 15 | 0.1 | 0.12 | 0.95 | 1,200 | 20 | Sulfuric acid | 2 | 70 | 30 | Sheet width direction | 500 | 3 | 750 |
| Test 2-7 | 20 | 0.1 | 0.10 | 0.92 | 1,200 | 20 | Sulfuric acid | 0.5 | 70 | 15 | Sheet width direction | 500 | 3 | 750 |

TABLE 10-continued

| | Production conditions | | | | | | | | | | | | | |
|---|---|---|---|---|---|---|---|---|---|---|---|---|---|---|
| | | | | | | | Surface treatment process | | | | | | | |
| | | | | | | | Pickling treatment | | | | Brushing treatment | | | |
| | Cold rolling process | | Decarburization annealing process | | Final annealing process | | Type | Concentration | Liquid temperature | | Done (Rotation | | Brush rolling | Brush |
| | Final pass reduction rate % | Final pass roll roughness Ra μm | Oxidation degree in atmosphere | Surface oxygen amount g/m$^2$ | Soaking temperature ° C. | Soaking time hour | of treatment solution | of treatment solution mass % | of treatment solution ° C. | Immersion time sec | axis direction)/ Not done | Abrasive grain size | reduction mm | rotational speed rpm |
| Test 2-8 | 15 | 0.1 | 0.12 | 0.95 | 1,200 | 20 | Sulfuric acid | 2 | 80 | 30 | Rolling direction | 500 | 2 | 1,000 |
| Test 2-9 | 15 | 0.1 | 0.12 | 0.95 | 1,200 | 20 | Sulfuric acid | 2 | 80 | 30 | Sheet width direction | 500 | 2 | 500 |
| Test 2-10 | 15 | 0.1 | 0.12 | 0.95 | 1,200 | 20 | Sulfuric acid | 2 | 80 | 30 | Sheet width direction | 500 | 4 | 1,500 |
| Test 2-11 | 15 | 0.4 | 0.10 | 0.92 | 1,200 | 20 | Sulfuric acid | 0.5 | 60 | 30 | Rolling direction | 500 | 4 | 1,000 |
| Test 2-12 | 15 | 0.4 | 0.10 | 0.92 | 1,200 | 20 | Sulfuric acid | 0.5 | 60 | 30 | Sheet width direction | 500 | 4 | 500 |
| Test 2-13 | 15 | 0.4 | 0.10 | 0.92 | 1,200 | 20 | Sulfuric acid | 0.5 | 60 | 30 | Sheet width direction | 500 | 3 | 750 |
| Test 2-14 | 30 | 0.1 | 0.09 | 0.88 | 1,150 | 30 | Sulfuric acid | 0.5 | 70 | 30 | Sheet width direction | 500 | 3 | 750 |

TABLE 11

| | Production conditions | | | | | | | | | | | | | |
|---|---|---|---|---|---|---|---|---|---|---|---|---|---|---|
| | | | | | | | Surface treatment process | | | | | | | |
| | | | | | | | Pickling treatment | | | | Brushing treatment | | | |
| | Cold rolling process | | Decarburization annealing process | | Final annealing process | | Type | Concentration | Liquid | | Done (Rotation | | Brush rolling | Brush |
| | Final pass reduction rate % | Final pass roll roughness Ra μm | Oxidation degree in atmosphere | Surface oxygen amount g/m$^2$ | Soaking temperature ° C. | Soaking time hour | of treatment solution | of treatment solution mass % | temperature of treatment solution ° C. | Immersion time sec | axis direction)/ Not done | Abrasive grain size | reduction mm | rotational speed rpm |
| Test 2-15 | 30 | 0.1 | 0.09 | 0.88 | 1,250 | 10 | Sulfuric acid | 0.5 | 70 | 15 | Sheet width direction | 500 | 3 | 750 |
| Test 2-16 | 20 | 0.1 | 0.09 | 0.88 | 1,200 | 20 | Hydrochloric acid | 5 | 70 | 15 | Sheet width direction | 500 | 3 | 750 |
| Test 2-17 | 20 | 0.1 | 0.09 | 0.88 | 1,200 | 20 | Hydrochloric acid | 5 | 60 | 15 | Sheet width direction | 500 | 3 | 750 |
| Test 2-18 | 20 | 0.1 | 0.09 | 0.88 | 1,200 | 20 | Hydrochloric acid | 0.5 | 70 | 15 | Sheet width direction | 500 | 3 | 750 |
| Test 2-19 | 20 | 0.1 | 0.09 | 0.88 | 1,200 | 20 | Sulfuric acid + phosphoric acid | 3 + 1 | 70 | 15 | Sheet width direction | 500 | 3 | 750 |
| Test 2-20 | 20 | 0.1 | 0.09 | 0.88 | 1,200 | 20 | Sulfuric acid | 0.5 | 70 | 15 | Sheet width direction | 500 | 3 | 750 |
| Test 2-21 | 5 | 0.5 | 0.10 | 0.92 | 1,200 | 20 | Sulfuric acid | 3 | 80 | 30 | Not done | — | — | — |
| Test 2-22 | 10 | 0.4 | 0.17 | 1.07 | 1,200 | 20 | Sulfuric acid | 7.5 | 80 | 30 | Not done | — | — | — |
| Test 2-23 | 10 | 0.4 | 0.10 | 0.92 | 1,200 | 20 | Sulfuric acid | 25 | 80 | 60 | Not done | — | — | — |

TABLE 11-continued

| | Production conditions | | | | | | | | | | | | | |
|---|---|---|---|---|---|---|---|---|---|---|---|---|---|---|
| | | | | | | | Surface treatment process | | | | | | | |
| | Cold rolling process | | Decarburization annealing process | | Final annealing process | | Pickling treatment | | | | Brushing treatment | | | |
| | Final pass reduction rate % | Final pass roll roughness Ra μm | Oxidation degree in atmosphere | Surface oxygen amount g/m$^2$ | Soaking temperature ° C. | Soaking time hour | Type of treatment solution | Concentration of treatment solution mass % | Liquid temperature of treatment solution ° C. | Immersion time sec | Done (Rotation axis direction)/Not done | Abrasive grain size | Brushing reduction mm | Brush rotational speed rpm |
| Test 2-24 | 20 | 0.1 | 0.09 | 0.89 | 1,200 | 20 | Sulfuric acid | 0.5 | 60 | 30 | Sheet width direction | 500 | 3 | 750 |
| Test 2-25 | 20 | 0.1 | 0.09 | 0.90 | 1,200 | 20 | Sulfuric acid | 0.5 | 60 | 30 | Sheet width direction | 500 | 3 | 750 |
| Test 2-26 | 20 | 0.1 | 0.09 | 0.88 | 1,200 | 20 | Sulfuric acid | 0.5 | 60 | 30 | Sheet width direction | 500 | 3 | 750 |
| Test 2-27 | 20 | 0.1 | 0.09 | 0.89 | 1,200 | 20 | Sulfuric acid | 0.5 | 60 | 30 | Sheet width direction | 500 | 3 | 750 |
| Test 2-28 | 20 | 0.1 | 0.09 | 0.87 | 1,200 | 20 | Sulfuric acid | 0.5 | 60 | 30 | Sheet width direction | 500 | 3 | 750 |

TABLE 12

| | Production conditions | | | | | | | | | | | | | |
|---|---|---|---|---|---|---|---|---|---|---|---|---|---|---|
| | | | | | | | Surface treatment process | | | | | | | |
| | Cold rolling process | | Decarburization annealing process | | Final annealing process | | Pickling treatment | | | | Brushing treatment | | | |
| | Final pass reduction rate % | Final pass roll roughness Ra μm | Oxidation degree in atmosphere | Surface oxygen amount g/m$^2$ | Soaking temperature ° C. | Soaking time hour | Type of treatment solution | Concentration of treatment solution mass % | Liquid temperature of treatment solution ° C. | Immersion time sec | Done (Rotation axis direction)/Not done | Abrasive grain size | Brushing reduction mm | Brush rotational speed rpm |
| Test 2-29 | 20 | 0.1 | 0.09 | 0.87 | 1,200 | 20 | Sulfuric acid | 0.5 | 60 | 30 | Sheet width direction | 500 | 3 | 750 |
| Test 2-30 | 20 | 0.1 | 0.09 | 0.89 | 1,200 | 20 | Sulfuric acid | 0.5 | 60 | 30 | Sheet width direction | 500 | 3 | 750 |
| Test 2-31 | 20 | 0.1 | 0.09 | 0.88 | 1,200 | 20 | Sulfuric acid | 0.5 | 60 | 30 | Sheet width direction | 500 | 3 | 750 |
| Test 2-32 | 20 | 0.1 | 0.09 | 0.89 | 1,200 | 20 | Sulfuric acid | 0.5 | 60 | 30 | Sheet width direction | 500 | 3 | 750 |
| Test 2-33 | 20 | 0.1 | 0.09 | 0.88 | 1,200 | 20 | Sulfuric acid | 0.5 | 60 | 30 | Sheet width direction | 500 | 3 | 750 |
| Test 2-34 | 20 | 0.1 | 0.09 | 0.87 | 1,200 | 20 | Sulfuric acid | 0.5 | 60 | 30 | Sheet width direction | 500 | 3 | 750 |
| Test 2-35 | 20 | 0.1 | 0.09 | 0.88 | 1,200 | 20 | Sulfuric acid | 0.5 | 60 | 30 | Sheet width direction | 500 | 3 | 750 |
| Test 2-36 | 20 | 0.1 | 0.09 | 0.90 | 1,200 | 20 | Sulfuric acid | 0.5 | 60 | 30 | Sheet width direction | 500 | 3 | 750 |
| Test 2-37 | 15 | 0.4 | 0.10 | 0.92 | 1,200 | 20 | Sulfuric acid | 3 | 80 | 30 | Not done | — | — | — |

TABLE 12-continued

| | Production conditions | | | | | | | | | | | | | |
|---|---|---|---|---|---|---|---|---|---|---|---|---|---|---|
| | | | | | | | Surface treatment process | | | | | | | |
| | Cold rolling process | | Decarburization annealing process | | Final annealing process | | Pickling treatment | | | | Brushing treatment | | | |
| | Final pass reduction rate % | Final pass roll roughness Ra μm | Oxidation degree in atmosphere | Surface oxygen amount g/m$^2$ | Soaking temperature ° C. | Soaking time hour | Type of treatment solution | Concentration of treatment solution mass % | Liquid temperature of treatment solution ° C. | Immersion time sec | Done (Rotation axis direction)/ Not done | Abrasive grain size | Brushing reduction mm | Brush rotational speed rpm |
| Test 2-38 | 15 | 0.4 | 0.12 | 0.96 | 1,200 | 20 | Sulfuric acid | 2 | 80 | 30 | Sheet width direction | 500 | 3 | 750 |
| Test 2-39 | 15 | 0.5 | 0.10 | 0.92 | 1,200 | 20 | Sulfuric acid | 7.5 | 80 | 30 | Sheet width direction | 500 | 3 | 750 |
| Test 2-40 | 15 | 0.4 | 0.17 | 1.10 | 1,100 | 20 | Sulfuric acid | 7.5 | 80 | 30 | Sheet width direction | 500 | 3 | 750 |
| Test 2-41 | 15 | 0.4 | 0.15 | 0.95 | 1,100 | 20 | Sulfuric acid | 7.5 | 80 | 30 | Sheet width direction | 500 | 3 | 750 |
| Test 2-42 | 15 | 0.4 | 0.10 | 0.92 | 1,200 | 5 | Sulfuric acid | 7.5 | 80 | 30 | Sheet width direction | 500 | 3 | 750 |

TABLE 13

| | Production conditions | | | | | | | | | | | | | |
|---|---|---|---|---|---|---|---|---|---|---|---|---|---|---|
| | | | | | | | Surface treatment process | | | | | | | |
| | Cold rolling process | | Decarburization annealing process | | Final annealing process | | Pickling treatment | | | | Brushing treatment | | | |
| | Final pass reduction rate % | Final pass roll roughness Ra μm | Oxidation degree in atmosphere | Surface oxygen amount g/m$^2$ | Soaking temperature ° C. | Soaking time hour | Type of treatment solution | Concentration of treatment solution mass % | Liquid temperature of treatment solution ° C. | Immersion time sec | Done (Rotation axis direction)/ Not done | Abrasive grain size | Brushing reduction mm | Brush rotational speed rpm |
| Test 2-43 | 15 | 0.4 | 0.10 | 0.92 | 1,200 | 20 | Not applied | Not applied | Not applied | Not applied | Sheet width direction | 500 | 3 | 750 |
| Test 2-44 | 15 | 0.4 | 0.15 | 0.95 | 1,200 | 20 | Sulfuric acid | 7.5 | 25 | 15 | Sheet width direction | 500 | 3 | 750 |
| Test 2-45 | 15 | 0.4 | 0.10 | 0.92 | 1,200 | 20 | Sulfuric acid | 25 | 50 | 30 | Sheet width direction | 500 | 3 | 750 |
| Test 2-46 | 10 | 0.4 | 0.10 | 0.92 | 1,150 | 30 | Sulfuric acid | 3 | 70 | 15 | Sheet width direction | 500 | 3 | 750 |
| Test 2-47 | 15 | 0.4 | 0.10 | 0.92 | 1,200 | 20 | Sulfuric acid | 0.5 | 70 | 30 | Sheet width direction | 50 | 3 | 750 |
| Test 2-48 | 15 | 0.4 | 0.10 | 0.92 | 1,200 | 20 | Sulfuric acid | 0.5 | 70 | 30 | Sheet width direction | 600 | 3 | 750 |
| Test 2-49 | 15 | 0.4 | 0.10 | 0.92 | 1,200 | 20 | Sulfuric acid | 0.5 | 70 | 30 | Sheet width direction | 500 | 0.5 | 750 |
| Test 2-50 | 15 | 0.4 | 0.10 | 0.92 | 1,200 | 20 | Sulfuric acid | 0.5 | 70 | 30 | Sheet width direction | 500 | 6 | 750 |
| Test 2-51 | 15 | 0.4 | 0.10 | 0.92 | 1,200 | 20 | Sulfuric acid | 0.5 | 70 | 30 | Sheet width direction | 500 | 3 | 400 |

TABLE 13-continued

| | Production conditions | | | | | | | | | | | | | |
|---|---|---|---|---|---|---|---|---|---|---|---|---|---|---|
| | | | | | | | Surface treatment process | | | | | | | |
| | Cold rolling process | | Decarburization annealing process | | Final annealing process | | Pickling treatment | | | | Brushing treatment | | | |
| | Final pass reduction rate % | Final pass roll roughness Ra μm | Oxidation degree in atmosphere | Surface oxygen amount g/m$^2$ | Soaking temperature ° C. | Soaking time hour | Type of treatment solution | Concentration of treatment solution mass % | Liquid temperature of treatment solution ° C. | Immersion time sec | Done (Rotation axis direction)/ Not done | Abrasive grain size | Brushing reduction mm | Brush rotational speed rpm |
| Test 2-52 | 15 | 0.4 | 0.10 | 0.92 | 1,200 | 20 | Sulfuric acid | 0.5 | 70 | 30 | Sheet width direction | 500 | 3 | 1,800 |
| Test 2-53 | 15 | 0.4 | 0.10 | 0.92 | 1,150 | 30 | Sulfuric acid | 7.5 | 70 | 15 | Sheet width direction | 500 | 3 | 750 |
| Test 2-54 | 30 | 0.1 | 0.02 | 0.30 | 1,250 | 30 | Sulfuric acid | 0.3 | 70 | 15 | Sheet width direction | 500 | 2 | 500 |
| Test 2-55 | 25 | 0.1 | 0.01 | 0.35 | 1,250 | 30 | Sulfuric acid | 0.3 | 60 | 15 | Sheet width direction | 500 | 2 | 500 |

TABLE 14

| | Production results Component composition of silicon steel sheet (unit: mass %, remainder being Fe and impurities) | | | | | | | | | | | | | | | | | | |
|---|---|---|---|---|---|---|---|---|---|---|---|---|---|---|---|---|---|---|---|
| | Si | Mn | Cr | Cu | P | Sn | Sb | Ni | B | V | Nb | Mo | Ti | Bi | Al | C | N | S | Se |
| Test 2-1 | 3.2 | — | — | — | — | — | — | — | — | — | — | — | — | — | 0.001 | 0.0008 | 0.0011 | 0.0014 | — |
| Test 2-2 | 3.2 | — | — | — | — | — | — | — | — | — | — | — | — | — | 0.001 | 0.0009 | 0.0012 | 0.0012 | — |
| Test 2-3 | 3.2 | — | — | — | — | — | — | — | — | — | — | — | — | — | 0.001 | 0.0010 | 0.0009 | 0.0013 | — |
| Test 2-4 | 3.2 | — | — | — | — | — | — | — | — | — | — | — | — | — | 0.001 | 0.0012 | 0.0012 | 0.0014 | — |
| Test 2-5 | 3.2 | — | — | — | — | — | — | — | — | — | — | — | — | — | 0.001 | 0.0013 | 0.0010 | 0.0013 | — |
| Test 2-6 | 3.2 | — | — | — | — | — | — | — | — | — | — | — | — | — | 0.001 | 0.0011 | 0.0011 | 0.0014 | — |
| Test 2-7 | 3.2 | — | — | — | — | — | — | — | — | — | — | — | — | — | 0.001 | 0.0011 | 0.0013 | 0.0013 | — |
| Test 2-8 | 3.2 | — | — | — | — | — | — | — | — | — | — | — | — | — | 0.001 | 0.0010 | 0.0009 | 0.0011 | — |
| Test 2-9 | 3.2 | — | — | — | — | — | — | — | — | — | — | — | — | — | 0.001 | 0.0011 | 0.0010 | 0.0014 | — |
| Test 2-10 | 3.2 | — | — | — | — | — | — | — | — | — | — | — | — | — | 0.001 | 0.0010 | 0.0009 | 0.0013 | — |
| Test 2-11 | 3.2 | — | — | — | — | — | — | — | — | — | — | — | — | — | 0.001 | 0.0012 | 0.0010 | 0.0012 | — |
| Test 2-12 | 3.2 | — | — | — | — | — | — | — | — | — | — | — | — | — | 0.001 | 0.0012 | 0.0010 | 0.0014 | — |
| Test 2-13 | 3.2 | — | — | — | — | — | — | — | — | — | — | — | — | — | 0.001 | 0.0013 | 0.0011 | 0.0013 | — |
| Test 2-14 | 3.2 | — | — | — | — | — | — | — | — | — | — | — | — | — | 0.001 | 0.0012 | 0.0012 | 0.0014 | — |

TABLE 15

| | Production results Component composition of silicon steel sheet (unit: mass %, remainder being Fe and impurities) | | | | | | | | | | | | | | | | | | |
|---|---|---|---|---|---|---|---|---|---|---|---|---|---|---|---|---|---|---|---|
| | Si | Mn | Cr | Cu | P | Sn | Sb | Ni | B | V | Nb | Mo | Ti | Bi | Al | C | N | S | Se |
| Test 2-15 | 3.2 | — | — | — | — | — | — | — | — | — | — | — | — | — | 0.001 | 0.0013 | 0.0008 | 0.0008 | — |
| Test 2-16 | 3.2 | — | — | — | — | — | — | — | — | — | — | — | — | — | 0.001 | 0.0012 | 0.0011 | 0.0012 | — |

TABLE 15-continued

| | Production results<br>Component composition of silicon steel sheet (unit: mass %, remainder being Fe and impurities) | | | | | | | | | | | | | | | | | | |
|---|---|---|---|---|---|---|---|---|---|---|---|---|---|---|---|---|---|---|---|
| | Si | Mn | Cr | Cu | P | Sn | Sb | Ni | B | V | Nb | Mo | Ti | Bi | Al | C | N | S | Se |
| Test 2-17 | 3.2 | — | — | — | — | — | — | — | — | — | — | — | — | — | 0.001 | 0.0012 | 0.0012 | 0.0013 | — |
| Test 2-18 | 3.2 | — | — | — | — | — | — | — | — | — | — | — | — | — | 0.001 | 0.0011 | 0.0013 | 0.0012 | — |
| Test 2-19 | 3.2 | — | — | — | — | — | — | — | — | — | — | — | — | — | 0.001 | 0.0011 | 0.0012 | 0.0012 | — |
| Test 2-20 | 3.2 | — | — | — | — | — | — | — | — | — | — | — | — | — | 0.001 | 0.0012 | 0.0011 | 0.0011 | — |
| Test 2-21 | 3.2 | — | — | — | — | — | — | — | — | — | — | — | — | — | 0.001 | 0.0010 | 0.0012 | 0.0013 | — |
| Test 2-22 | 3.2 | — | — | — | — | — | — | — | — | — | — | — | — | — | 0.001 | 0.0006 | 0.0012 | 0.0012 | — |
| Test 2-23 | 3.2 | — | — | — | — | — | — | — | — | — | — | — | — | — | 0.001 | 0.0012 | 0.0011 | 0.0013 | — |
| Test 2-24 | 3.3 | 0.1 | — | — | — | — | — | — | — | — | — | — | — | — | 0.001 | 0.0007 | 0.0006 | 0.0013 | — |
| Test 2-25 | 3.3 | — | 0.1 | — | — | — | — | — | — | — | — | — | — | — | 0.001 | 0.0009 | 0.0013 | 0.0008 | 0.0015 |
| Test 2-26 | 3.3 | — | — | 0.1 | — | — | — | — | — | — | — | — | — | — | 0.001 | 0.0011 | 0.0010 | 0.0012 | — |
| Test 2-27 | 3.3 | — | — | — | 0.01 | — | — | — | — | — | — | — | — | — | 0.001 | 0.0007 | 0.0006 | 0.0014 | — |
| Test 2-28 | 3.3 | — | — | — | — | 0.05 | — | — | — | — | — | — | — | — | 0.001 | 0.0009 | 0.0011 | 0.0008 | 0.0016 |

TABLE 16

| | Production results<br>Component composition of silicon steel sheet (unit: mass %, remainder being Fe and impurities) | | | | | | | | | | | | | | | | | | |
|---|---|---|---|---|---|---|---|---|---|---|---|---|---|---|---|---|---|---|---|
| | Si | Mn | Cr | Cu | P | Sn | Sb | Ni | B | V | Nb | Mo | Ti | Bi | Al | C | N | S | Se |
| Test 2-29 | 3.3 | — | — | — | — | — | 0.03 | — | — | — | — | — | — | — | 0.001 | 0.0009 | 0.0010 | 0.0013 | — |
| Test 2-30 | 3.3 | — | — | — | — | — | — | 0.05 | — | — | — | — | — | — | 0.001 | 0.0013 | 0.0010 | 0.0009 | 0.0014 |
| Test 2-31 | 3.3 | — | — | — | — | — | — | — | 0.002 | — | — | — | — | — | 0.001 | 0.0013 | 0.0011 | 0.0008 | 0.0015 |
| Test 2-32 | 3.3 | — | — | — | — | — | — | — | — | 0.02 | — | — | — | — | 0.002 | 0.0014 | 0.0009 | 0.0014 | — |
| Test 2-33 | 3.3 | — | — | — | — | — | — | — | — | — | 0.03 | — | — | — | 0.001 | 0.0013 | 0.0010 | 0.0013 | — |
| Test 2-34 | 3.3 | — | — | — | — | — | — | — | — | — | — | 0.02 | — | — | 0.001 | 0.0007 | 0.0006 | 0.0012 | — |
| Test 2-35 | 3.3 | — | — | — | — | — | — | — | — | — | — | — | 0.005 | — | 0.001 | 0.0012 | 0.0011 | 0.0014 | — |
| Test 2-36 | 3.3 | — | — | — | — | — | — | — | — | — | — | — | — | 0.003 | 0.001 | 0.0012 | 0.0010 | 0.0007 | 0.0017 |
| Test 2-37 | 3.2 | — | — | — | — | — | — | — | — | — | — | — | — | — | 0.001 | 0.0011 | 0.0011 | 0.0011 | — |
| Test 2-38 | 3.2 | — | — | — | — | — | — | — | — | — | — | — | — | — | 0.001 | 0.0010 | 0.0012 | 0.0012 | — |
| Test 2-39 | 3.2 | — | — | — | — | — | — | — | — | — | — | — | — | — | 0.001 | 0.0013 | 0.0011 | 0.0011 | — |
| Test 2-40 | 3.2 | — | — | — | — | — | — | — | — | — | — | — | — | — | 0.001 | 0.0008 | 0.0013 | 0.0014 | — |
| Test 2-41 | 3.2 | — | — | — | — | — | — | — | — | — | — | — | — | — | 0.001 | 0.0009 | 0.0014 | 0.0014 | — |
| Test 2-42 | 3.2 | — | — | — | — | — | — | — | — | — | — | — | — | — | 0.001 | 0.0010 | 0.0014 | 0.0014 | — |

TABLE 17

| | Production results Component composition of silicon steel sheet (unit: mass %, remainder being Fe and impurities) | | | | | | | | | | | | | | | | | |
|---|---|---|---|---|---|---|---|---|---|---|---|---|---|---|---|---|---|---|
| | Si | Mn | Cr | Cu | P | Sn | Sb | Ni | B | V | Nb | Mo | Ti | Bi | Al | C | N | S | Se |
| Test 2-43 | 3.2 | — | — | — | — | — | — | — | — | — | — | — | — | — | 0.001 | 0.0011 | 0.0012 | 0.0012 | — |
| Test 2-44 | 3.2 | — | — | — | — | — | — | — | — | — | — | — | — | — | 0.001 | 0.0008 | 0.0011 | 0.0013 | — |
| Test 2-45 | 3.2 | — | — | — | — | — | — | — | — | — | — | — | — | — | 0.001 | 0.0012 | 0.0012 | 0.0011 | — |
| Test 2-46 | 3.2 | — | — | — | — | — | — | — | — | — | — | — | — | — | 0.001 | 0.0010 | 0.0013 | 0.0014 | — |
| Test 2-47 | 3.2 | — | — | — | — | — | — | — | — | — | — | — | — | — | 0.001 | 0.0011 | 0.0011 | 0.0012 | — |
| Test 2-48 | 3.2 | — | — | — | — | — | — | — | — | — | — | — | — | — | 0.001 | 0.0011 | 0.0012 | 0.0011 | — |
| Test 2-49 | 3.2 | — | — | — | — | — | — | — | — | — | — | — | — | — | 0.001 | 0.0010 | 0.0013 | 0.0012 | — |
| Test 2-50 | 3.2 | — | — | — | — | — | — | — | — | — | — | — | — | — | 0.001 | 0.0011 | 0.0011 | 0.0010 | — |
| Test 2-51 | 3.2 | — | — | — | — | — | — | — | — | — | — | — | — | — | 0.001 | 0.0011 | 0.0012 | 0.0011 | — |
| Test 2-52 | 3.2 | — | — | — | — | — | — | — | — | — | — | — | — | — | 0.001 | 0.0012 | 0.0012 | 0.0012 | — |
| Test 2-53 | 3.2 | — | — | — | — | — | — | — | — | — | — | — | — | — | 0.001 | 0.0011 | 0.0013 | 0.0013 | — |
| Test 2-54 | 3.2 | — | — | — | — | — | — | — | — | — | — | — | — | — | 0.001 | 0.0008 | 0.0008 | 0.0008 | — |
| Test 2-55 | 3.2 | — | — | — | — | — | — | — | — | — | — | — | — | — | 0.001 | 0.0008 | 0.0009 | 0.0007 | — |

TABLE 18

| | Production results Surface properties of silicon steel sheet | | | | Evaluation results Iron loss in rolling direction | Iron loss in sheet width direction | |
|---|---|---|---|---|---|---|---|
| | ave-AMP$_{C100}$ μm | ave-AMP$_{C50}$ μm | max-DIV$_{100}$ μm | max-DIV$_{50}$ μm | $W_{17/50}$ W/kg | $W_{6/50}$ W/kg | Note |
| Test 2-1 | 0.060 | 0.044 | 1.2 | 1.1 | 0.72 | 0.95 | Comparative example |
| Test 2-2 | 0.059 | 0.043 | 1.3 | 1.1 | 0.71 | 0.92 | Comparative example |
| Test 2-3 | 0.052 | 0.038 | 1.4 | 1.3 | 0.70 | 0.90 | Comparative example |
| Test 2-4 | 0.050 | 0.038 | 1.6 | 1.4 | 0.68 | 0.65 | Example of present invention |
| Test 2-5 | 0.046 | 0.034 | 2.0 | 1.7 | 0.66 | 0.62 | Example of present invention |
| Test 2-6 | 0.044 | 0.032 | 2.1 | 1.6 | 0.66 | 0.61 | Example of present invention |
| Test 2-7 | 0.027 | 0.019 | 2.5 | 2.1 | 0.65 | 0.58 | Example of present invention |
| Test 2-8 | 0.044 | 0.032 | 1.2 | 1.1 | 0.65 | 0.86 | Example of present invention |
| Test 2-9 | 0.049 | 0.038 | 1.8 | 1.5 | 0.68 | 0.66 | Example of present invention |
| Test 2-10 | 0.043 | 0.031 | 2.1 | 1.8 | 0.65 | 0.60 | Example of present invention |
| Test 2-11 | 0.042 | 0.031 | 1.3 | 1.3 | 0.65 | 0.87 | Example of present invention |
| Test 2-12 | 0.047 | 0.034 | 1.8 | 1.5 | 0.66 | 0.64 | Example of present invention |

TABLE 18-continued

| | Production results Surface properties of silicon steel sheet | | | | Evaluation results Iron loss in rolling | Iron loss in sheet width | |
|---|---|---|---|---|---|---|---|
| | ave-AMP$_{C100}$ μm | ave-AMP$_{C50}$ μm | max-DIV$_{100}$ μm | max-DIV$_{50}$ μm | direction $W_{17/50}$ W/kg | direction $W_{6/50}$ W/kg | Note |
| Test 2-13 | 0.043 | 0.031 | 2.2 | 1.9 | 0.65 | 0.59 | Example of present invention |
| Test 2-14 | 0.030 | 0.022 | 1.9 | 1.6 | 0.66 | 0.76 | Example of present invention |

TABLE 19

| | Production results Surface properties of silicon steel sheet | | | | Evaluation results Iron loss in rolling | Iron loss in sheet width | |
|---|---|---|---|---|---|---|---|
| | ave-AMP$_{C100}$ μm | ave-AMP$_{C50}$ μm | max-DIV$_{100}$ μm | max-DIV$_{50}$ μm | direction $W_{17/50}$ W/kg | direction $W_{6/50}$ W/kg | Note |
| Test 2-15 | 0.025 | 0.018 | 3.0 | 2.5 | 0.64 | 0.52 | Example of present invention |
| Test 2-16 | 0.036 | 0.026 | 2.2 | 1.8 | 0.68 | 0.66 | Example of present invention |
| Test 2-17 | 0.030 | 0.021 | 2.4 | 2.0 | 0.64 | 0.62 | Example of present invention |
| Test 2-18 | 0.027 | 0.019 | 2.6 | 2.2 | 0.65 | 0.56 | Example of present invention |
| Test 2-19 | 0.033 | 0.023 | 1.9 | 1.6 | 0.68 | 0.76 | Example of present invention |
| Test 2-20 | 0.028 | 0.021 | 2.5 | 2.1 | 0.64 | 0.58 | Example of present invention |
| Test 2-21 | 0.061 | 0.045 | 1.3 | 1.1 | 0.72 | 0.96 | Comparative example |
| Test 2-22 | 0.184 | 0.134 | 1.1 | 0.9 | 0.77 | 0.99 | Comparative example |
| Test 2-23 | 0.098 | 0.072 | 1.1 | 0.9 | 0.73 | 0.93 | Comparative example |
| Test 2-24 | 0.028 | 0.020 | 2.4 | 2.0 | 0.64 | 0.60 | Example of present invention |
| Test 2-25 | 0.027 | 0.019 | 2.7 | 2.4 | 0.65 | 0.54 | Example of present invention |
| Test 2-26 | 0.026 | 0.018 | 2.1 | 1.8 | 0.64 | 0.69 | Example of present invention |
| Test 2-27 | 0.027 | 0.020 | 2.3 | 1.9 | 0.65 | 0.63 | Example of present invention |
| Test 2-28 | 0.025 | 0.018 | 3.0 | 2.5 | 0.64 | 0.48 | Example of present invention |

TABLE 20

| | Production results Surface properties of silicon steel sheet | | | | Evaluation results Iron loss in rolling direction | Iron loss in sheet width direction | |
|---|---|---|---|---|---|---|---|
| | ave-AMP$_{C100}$ μm | ave-AMP$_{C50}$ μm | max-DIV$_{100}$ μm | max-DIV$_{50}$ μm | $W_{17/50}$ W/kg | $W_{6/50}$ W/kg | Note |
| Test 2-29 | 0.025 | 0.019 | 2.4 | 2.1 | 0.63 | 0.60 | Example of present invention |
| Test 2-30 | 0.027 | 0.020 | 2.7 | 2.3 | 0.65 | 0.54 | Example of present invention |
| Test 2-31 | 0.026 | 0.019 | 2.5 | 2.0 | 0.63 | 0.58 | Example of present invention |
| Test 2-32 | 0.028 | 0.021 | 2.3 | 1.9 | 0.64 | 0.63 | Example of present invention |
| Test 2-33 | 0.029 | 0.022 | 2.4 | 1.9 | 0.65 | 0.60 | Example of present invention |
| Test 2-34 | 0.026 | 0.020 | 2.6 | 2.2 | 0.64 | 0.56 | Example of present invention |
| Test 2-35 | 0.026 | 0.019 | 2.3 | 1.9 | 0.65 | 0.63 | Example of present invention |
| Test 2-36 | 0.027 | 0.020 | 2.7 | 2.4 | 0.63 | 0.54 | Example of present invention |
| Test 2-37 | 0.045 | 0.029 | 1.2 | 1.1 | 0.66 | 0.87 | Example of present invention |
| Test 2-38 | 0.048 | 0.037 | 1.4 | 1.3 | 0.68 | 0.83 | Example of present invention |
| Test 2-39 | 0.067 | 0.049 | 1.4 | 1.3 | 0.72 | 0.81 | Comparative example |
| Test 2-40 | 0.180 | 0.131 | 1.1 | 0.9 | 0.79 | 0.93 | Comparative example |
| Test 2-41 | 0.053 | 0.040 | 1.4 | 1.3 | 0.71 | 0.83 | Comparative example |
| Test 2-42 | 0.056 | 0.042 | 1.4 | 1.3 | 0.73 | 0.81 | Comparative example |

TABLE 21

| | Production results Surface properties of silicon steel sheet | | | | Evaluation results Iron loss in rolling direction | Iron loss in sheet width direction | |
|---|---|---|---|---|---|---|---|
| | ave-AMP$_{C100}$ μm | ave-AMP$_{C50}$ μm | max-DIV$_{100}$ μm | max-DIV$_{50}$ μm | $W_{17/50}$ W/kg | $W_{6/50}$ W/kg | Note |
| Test 2-43 | 0.122 | 0.038 | 1.3 | 1.0 | 0.84 | 0.86 | Comparative example |
| Test 2-44 | 0.093 | 0.068 | 1.3 | 1.1 | 0.74 | 0.85 | Comparative example |
| Test 2-45 | 0.090 | 0.066 | 1.4 | 1.3 | 0.73 | 0.82 | Comparative example |
| Test 2-46 | 0.049 | 0.039 | 1.4 | 1.2 | 0.68 | 0.81 | Example of present invention |
| Test 2-47 | 0.071 | 0.062 | 2.1 | 1.8 | 0.75 | 0.70 | Comparative example |
| Test 2-48 | 0.046 | 0.034 | 1.3 | 1.2 | 0.68 | 0.83 | Example of present invention |
| Test 2-49 | 0.044 | 0.030 | 1.4 | 1.3 | 0.66 | 0.81 | Example of present invention |

TABLE 21-continued

| | Production results Surface properties of silicon steel sheet | | | | Evaluation results Iron loss in rolling | Iron loss in sheet width | |
|---|---|---|---|---|---|---|---|
| | ave-$AMP_{C100}$ μm | ave-$AMP_{C50}$ μm | max-$DIV_{100}$ μm | max-$DIV_{50}$ μm | direction $W_{17/50}$ W/kg | direction $W_{6/50}$ W/kg | Note |
| Test 2-50 | 0.068 | 0.059 | 2.2 | 1.7 | 0.73 | 0.71 | Comparative example |
| Test 2-51 | 0.044 | 0.035 | 1.3 | 1.3 | 0.66 | 0.84 | Example of present invention |
| Test 2-52 | 0.055 | 0.041 | 1.7 | 1.5 | 0.70 | 0.69 | Comparative example |
| Test 2-53 | 0.049 | 0.036 | 2.1 | 1.8 | 0.68 | 0.70 | Example of present invention |
| Test 2-54 | 0.019 | 0.013 | 2.5 | 2.1 | 0.60 | 0.67 | Example of present invention |
| Test 2-55 | 0.022 | 0.015 | 2.4 | 2.2 | 0.61 | 0.68 | Example of present invention |

INDUSTRIAL APPLICABILITY

According to the above aspects of the present invention, when surface properties of the silicon steel sheet as a base are optimally controlled, it is possible to provide a grain-oriented electrical steel sheet that exhibits excellent iron loss characteristics and a method of producing the same. Therefore, the present invention has high industrial applicability.

The invention claimed is:

1. A grain-oriented electrical steel sheet including a silicon steel sheet as a base steel sheet, wherein, when an average value of amplitudes in a wavelength range of 20 to 100 μm among wavelength components obtained by performing Fourier analysis on a measured cross-sectional curve parallel to a sheet width direction of the silicon steel sheet is set as ave-$AMP_{C100}$, ave-$AMP_{C100}$ is 0.0001 to 0.050 μm.

2. The grain-oriented electrical steel sheet according to claim 1, wherein ave-$AMP_{C100}$ is 0.0001 to 0.025 μm.

3. The grain-oriented electrical steel sheet according to claim 1, wherein, when a maximum value of amplitudes in a wavelength range of 20 to 100 μm among wavelength components obtained by performing Fourier analysis on the measured cross-sectional curve parallel to the sheet width direction of the silicon steel sheet is set as max-$AMP_{C100}$ and a maximum value of amplitudes in a wavelength range of 20 to 100 μm among wavelength components obtained by performing Fourier analysis on a measured cross-sectional curve parallel to the rolling direction of the silicon steel sheet is set as max-$AMP_{L100}$, max-$DIV_{100}$, which is a value obtained by dividing max-$AMP_{C100}$ by max-$AMP_{L100}$, is 1.5 to 6.0.

4. The grain-oriented electrical steel sheet according to claim 1, wherein, when an average value of amplitudes in a wavelength range of 20 to 50 μm among the wavelength components obtained by performing Fourier analysis on the measured cross-sectional curve parallel to the sheet width direction of the silicon steel sheet is set as ave-$AMP_{C50}$, ave-$AMP_{C50}$ is 0.0001 to 0.035.

5. The grain-oriented electrical steel sheet according to claim 4, wherein, when a maximum value of amplitudes in a wavelength range of 20 to 50 μm among wavelength components obtained by performing Fourier analysis on the measured cross-sectional curve parallel to the sheet width direction of the silicon steel sheet is set as max-$AMP_{C50}$ and a maximum value of amplitudes in a wavelength range of 20 to 50 μm among wavelength components obtained by performing Fourier analysis on the measured cross-sectional curve parallel to the rolling direction of the silicon steel sheet is set as max-$AMP_{L50}$, max-$DIV_{50}$, which is a value obtained by dividing max-$AMP_{C50}$ by max-$AMP_{L50}$, is 1.5 to 5.0.

6. The grain-oriented electrical steel sheet according to claim 4, wherein ave-$AMP_{C50}$ is 0.0001 to 0.020 μm.

7. The grain-oriented electrical steel sheet according to claim 1, wherein the silicon steel sheet has a texture developed in the {110}<001> orientation.

8. The grain-oriented electrical steel sheet according to claim 1, further comprising an intermediate layer arranged in contact with the silicon steel sheet, wherein the intermediate layer is a silicon oxide film.

9. The grain-oriented electrical steel sheet according to claim 8, further comprising an insulation coating arranged in contact with the intermediate layer, wherein the insulation coating is a phosphoric acid-based coating.

10. The grain-oriented electrical steel sheet according to claim 8, further comprising an insulation coating arranged in contact with the intermediate layer, wherein the insulation coating is an aluminum borate-based coating.

11. A method of producing the grain-oriented electrical steel sheet according to claim 1, comprising producing a grain-oriented electrical steel sheet using the silicon steel sheet as a base.

12. The grain-oriented electrical steel sheet according to claim 2, wherein, when a maximum value of amplitudes in a wavelength range of 20 to 100 μm among wavelength components obtained by performing Fourier analysis on the measured cross-sectional curve parallel to the sheet width direction of the silicon steel sheet is set as max-$AMP_{C100}$ and a maximum value of amplitudes in a wavelength range of 20 to 100 μm among wavelength components obtained by performing Fourier analysis on a measured cross-sectional curve parallel to the rolling direction of the silicon steel sheet is set as max-$AMP_{L100}$, max-$DIV_{100}$, which is a value obtained by dividing max-$AMP_{C100}$ by max-$AMP_{L100}$, is 1.5 to 6.0.

13. The grain-oriented electrical steel sheet according to claim 2, wherein, when an average value of amplitudes in a wavelength range of 20 to 50 μm among the wavelength components obtained by performing Fourier analysis on the measured cross-sectional curve parallel to the sheet width direction of the silicon steel sheet is set as ave-$AMP_{C50}$, ave-$AMP_{C50}$ is 0.0001 to 0.035.

14. The grain-oriented electrical steel sheet according to claim 2, wherein the silicon steel sheet has a texture developed in the {110}<001> orientation.

15. The grain-oriented electrical steel sheet according to claim 2, further comprising an intermediate layer arranged in contact with the silicon steel sheet, wherein the intermediate layer is a silicon oxide film.

16. The grain-oriented electrical steel sheet according to claim 1, wherein the silicon steel sheet contains, as chemical components, by mass %, Si: 0.8% or more and 7.0% or less,
Mn: 0 or more and 1.00% or less,
Cr: 0 or more and 0.30% or less,
Cu: 0 or more and 0.40% or less,
P: 0 or more and 0.50% or less,
Sn: 0 or more and 0.30% or less,
Sb: 0 or more and 0.30% or less,
Ni: 0 or more and 1.00% or less,
B: 0 or more and 0.008% or less,
V: 0 or more and 0.15% or less,
Nb: 0 or more and 0.2% or less,
Mo: 0 or more and 0.10% or less,
Ti: 0 or more and 0.015% or less,
Bi: 0 or more and 0.010% or less,
Al: 0 or more and 0.005% or less,
C: 0 or more and 0.005% or less,
N: 0 or more and 0.005% or less,
S: 0 or more and 0.005% or less, and
Se: 0 or more and 0.005% or less, with the remainder comprising Fe and impurities.

17. The grain-oriented electrical steel sheet according to claim 2, wherein the silicon steel sheet contains, as chemical components, by mass %, Si: 0.8% or more and 7.0% or less,
Mn: 0 or more and 1.00% or less,
Cr: 0 or more and 0.30% or less,
Cu: 0 or more and 0.40% or less,
P: 0 or more and 0.50% or less,
Sn: 0 or more and 0.30% or less,
Sb: 0 or more and 0.30% or less,
Ni: 0 or more and 1.00% or less,
B: 0 or more and 0.008% or less,
V: 0 or more and 0.15% or less,
Nb: 0 or more and 0.2% or less,
Mo: 0 or more and 0.10% or less,
Ti: 0 or more and 0.015% or less,
Bi: 0 or more and 0.010% or less,
Al: 0 or more and 0.005% or less,
C: 0 or more and 0.005% or less,
N: 0 or more and 0.005% or less,
S: 0 or more and 0.005% or less, and
Se: 0 or more and 0.005% or less, with the remainder comprising Fe and impurities.

* * * * *